US008802191B2

(12) United States Patent
Zimmermann et al.

(10) Patent No.: US 8,802,191 B2
(45) **Date of Patent: *Aug. 12, 2014**

(54) METHOD FOR COATING A SUBSTRATE SURFACE AND COATED PRODUCT

(75) Inventors: Stefan Zimmermann, Laufenburg (DE); Uwe Papp, Harzburg (DE); Heinrich Kreye, Hamburg (DE); Tobias Schmidt, Eslohe (DE)

(73) Assignee: H. C. Starck GmbH, Goslar (DE)

( * ) Notice: Subject to any disclaimer, the term of this patent is extended or adjusted under 35 U.S.C. 154(b) by 1121 days.

This patent is subject to a terminal disclaimer.

(21) Appl. No.: 11/913,579

(22) PCT Filed: Apr. 28, 2006

(86) PCT No.: PCT/EP2006/003967

§ 371 (c)(1),
(2), (4) Date: Sep. 18, 2009

(87) PCT Pub. No.: WO2006/117144

PCT Pub. Date: Nov. 9, 2006

(65) Prior Publication Data

US 2010/0055487 A1 Mar. 4, 2010

Related U.S. Application Data

(60) Provisional application No. 60/678,057, filed on May 5, 2005.

(51) Int. Cl.
*B05D 1/12* (2006.01)

(52) U.S. Cl.
USPC ..... 427/191; 427/190; 427/192; 427/427; 427/294

(58) Field of Classification Search
USPC ..... 427/190–192, 294, 427
See application file for complete search history.

(56) References Cited

U.S. PATENT DOCUMENTS

| | | | |
|---|---|---|---|
| 3,436,299 | A | 4/1969 | Halek |
| 3,990,784 | A | 11/1976 | Gelber |
| 4,011,981 | A | 3/1977 | Danna et al. |
| 4,073,427 | A | 2/1978 | Keifert et al. |
| 4,140,172 | A | 2/1979 | Corey |
| 4,202,932 | A | 5/1980 | Chen et al. |
| 4,209,375 | A | 6/1980 | Gates et al. |
| 4,291,104 | A | 9/1981 | Keifert |
| 4,459,062 | A | 7/1984 | Siebert |
| 4,483,819 | A | 11/1984 | Albrecht et al. |
| 4,508,563 | A | 4/1985 | Bernard et al. |
| 4,510,171 | A | 4/1985 | Siebert |
| 4,537,641 | A | 8/1985 | Albrecht et al. |
| 4,722,756 | A | 2/1988 | Hard |
| 4,731,111 | A | 3/1988 | Kopatz et al. |
| 4,818,629 | A | 4/1989 | Jenstrom et al. |
| 4,915,745 | A | 4/1990 | Pollock et al. |
| 4,964,906 | A | 10/1990 | Fife |
| 5,061,527 | A | 10/1991 | Watanabe et al. |
| 5,091,244 | A | 2/1992 | Biornard |
| 5,147,125 | A | 9/1992 | Austin |
| 5,242,481 | A | 9/1993 | Kumar |
| 5,270,858 | A | 12/1993 | Dickey |
| 5,271,965 | A | 12/1993 | Browning |
| 5,302,414 | A | 4/1994 | Alkhimov et al. |
| 5,305,946 | A | 4/1994 | Heilmann |
| 5,330,798 | A | 7/1994 | Browning |
| 5,580,516 | A | 12/1996 | Kumar |
| 5,612,254 | A | 3/1997 | Mu et al. |
| 5,679,473 | A | 10/1997 | Murayama et al. |
| 5,693,203 | A | 12/1997 | Ohhashi et al. |
| 5,795,626 | A | 8/1998 | Gabel et al. |
| 5,859,654 | A | 1/1999 | Radke et al. |
| 5,954,856 | A | 9/1999 | Pathare et al. |
| 5,972,065 | A | 10/1999 | Dunn et al. |
| 5,993,513 | A | 11/1999 | Fife |
| 6,030,577 | A | 2/2000 | Commandeur et al. |
| 6,136,062 | A | 10/2000 | Loffelholz et al. |
| 6,139,913 | A | 10/2000 | Van Steenkiste et al. |
| 6,171,363 | B1 | 1/2001 | Shekhter et al. |
| 6,189,663 | B1 | 2/2001 | Smith et al. |
| 6,197,082 | B1 | 3/2001 | Dorvel et al. |

(Continued)

FOREIGN PATENT DOCUMENTS

| | | | |
|---|---|---|---|
| CA | 2482287 | | 10/2002 |
| DE | 10253794 | A1 | 6/2004 |

(Continued)

OTHER PUBLICATIONS

"Cold Gas Dynamic Spray CGSM Apparatus," Tev Tech LLC, available at: http://www.tevtechllc.com/cold_gas.html (accessed Dec. 14, 2009). "Cold Spray Process," Handbook of Thermal Spray Technology, ASM International, Sep. 2004, pp. 77-84.

Ajdelsztajn et al., "Synthesis and Mechanical Properties of Nanocrytalline Ni Coatings Producted by Cold Gas Dynamic Spraying," 201 Surface and Coatings Tech. 3-4, pp. 1166-1172 (Oct. 2006).

Examination Report in European Patent Application No. 09172234.8, mailed Jun. 16, 2010 (3 pages).

Gärtner et al., "The Cold Spray Process and its Potential for Industrial Applications," 15 J. of Thermal Sprsy Tech. 2, pp. 223-232 (Jun. 2006).

Hall et al., "The Effect of a Simple Annealing Heat Treatment on the Mechanical Properties of Cold-Sprayed Aluminum," 15 J. of Thermal Spray Tech. 2, pp. 233-238 (Jun. 2006.).

(Continued)

*Primary Examiner* — Frederick Parker
(74) *Attorney, Agent, or Firm* — Norman B. Thot

(57) ABSTRACT

Disclosed is a process for the reprocessing or production of a sputter target or an X-ray anode wherein a gas flow forms a gas/powder mixture with a powder of a material chosen from the group consisting of niobium, tantalum, tungsten, molybdenum, titanium, zirconium, mixtures of two or more thereof and alloys thereof with at least two thereof or with other metals, the powder has a particle size of 0.5 to 150 μm, wherein a supersonic speed is imparted to the gas flow and the jet of supersonic speed is directed on to the surface of the object to be reprocessed or produced.

28 Claims, 5 Drawing Sheets

(56) References Cited

U.S. PATENT DOCUMENTS

Figure 1:
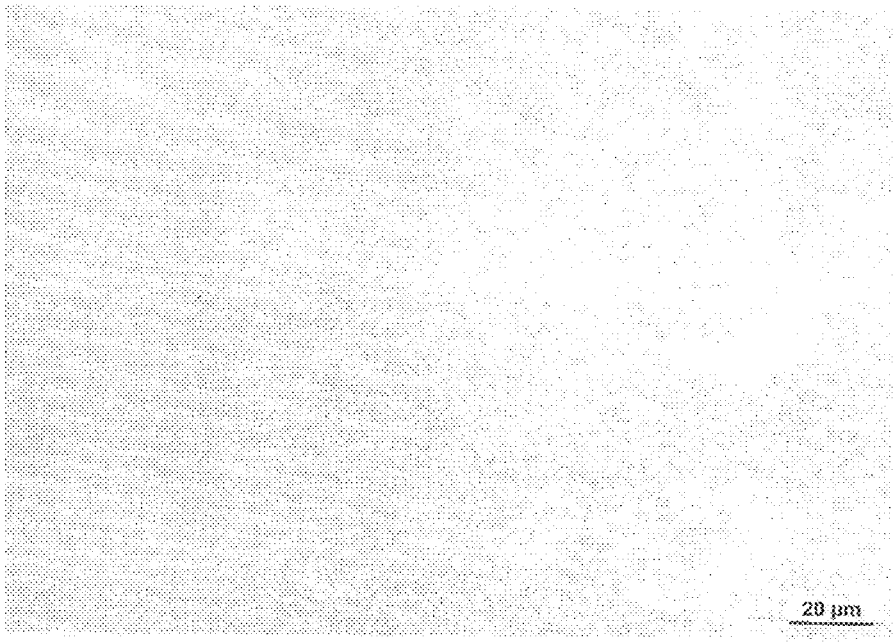

| | | | | |
|---|---|---|---|---|
| 6,238,456 | B1 | 5/2001 | Wolf et al. | |
| 6,245,390 | B1 | 6/2001 | Baranovski et al. | |
| 6,258,402 | B1 | 7/2001 | Hussary et al. | |
| 6,261,337 | B1 * | 7/2001 | Kumar | 75/255 |
| 6,328,927 | B1 | 12/2001 | Lo et al. | |
| 6,331,233 | B1 | 12/2001 | Turner | |
| 6,408,928 | B1 | 6/2002 | Heinrich et al. | |
| 6,444,259 | B1 | 9/2002 | Subramanian et al. | |
| 6,464,933 | B1 | 10/2002 | Popoola et al. | |
| 6,482,743 | B1 | 11/2002 | Sato | |
| 6,491,208 | B2 | 12/2002 | James et al. | |
| 6,502,767 | B2 | 1/2003 | Kay et al. | |
| 6,521,173 | B2 | 2/2003 | Kumar et al. | |
| 6,558,447 | B1 | 5/2003 | Shekhter et al. | |
| 6,589,311 | B1 | 7/2003 | Han et al. | |
| 6,623,796 | B1 | 9/2003 | Van Steenkiste | |
| 6,669,782 | B1 | 12/2003 | Thakur | |
| 6,722,584 | B2 | 4/2004 | Kay et al. | |
| 6,723,379 | B2 | 4/2004 | Stark | |
| 6,743,343 | B2 | 6/2004 | Kida et al. | |
| 6,743,468 | B2 | 6/2004 | Fuller et al. | |
| 6,749,002 | B2 | 6/2004 | Grinberg et al. | |
| 6,759,085 | B2 | 7/2004 | Muehlberger | |
| 6,770,154 | B2 | 8/2004 | Koenigsmann et al. | |
| 6,773,969 | B2 | 8/2004 | Lee et al. | |
| 6,780,458 | B2 | 8/2004 | Seth et al. | |
| 6,855,236 | B2 | 2/2005 | Sato et al. | |
| 6,872,425 | B2 | 3/2005 | Kaufold et al. | |
| 6,872,427 | B2 | 3/2005 | Van Steenkiste et al. | |
| 6,896,933 | B2 | 5/2005 | Van Steenkiste et al. | |
| 6,905,728 | B1 | 6/2005 | Hu et al. | |
| 6,911,124 | B2 | 6/2005 | Tang et al. | |
| 6,915,964 | B2 | 7/2005 | Tapphorn et al. | |
| 6,919,275 | B2 | 7/2005 | Chiang et al. | |
| 6,924,974 | B2 | 8/2005 | Stark | |
| 6,953,742 | B2 | 10/2005 | Chen et al. | |
| 6,962,407 | B2 | 11/2005 | Yamamoto et al. | |
| 7,053,294 | B2 | 5/2006 | Tuttle et al. | |
| 7,067,197 | B2 | 6/2006 | Michaluk et al. | |
| 7,081,148 | B2 | 7/2006 | Koenigsmann et al. | |
| 7,101,447 | B2 | 9/2006 | Turner | |
| 7,108,893 | B2 | 9/2006 | Van Steenkiste et al. | |
| 7,128,988 | B2 | 10/2006 | Lambeth | |
| 7,143,967 | B2 | 12/2006 | Heinrich et al. | |
| 7,163,715 | B1 | 1/2007 | Kramer | |
| 7,164,205 | B2 | 1/2007 | Yamaji et al. | |
| 7,170,915 | B2 | 1/2007 | McDonald | |
| 7,175,802 | B2 | 2/2007 | Sandlin et al. | |
| 7,178,744 | B2 | 2/2007 | Tapphorn et al. | |
| 7,183,206 | B2 | 2/2007 | Shepard | |
| 7,192,623 | B2 | 3/2007 | Andre et al. | |
| 7,208,230 | B2 | 4/2007 | Ackerman et al. | |
| 7,244,466 | B2 | 7/2007 | Van Steenkiste et al. | |
| 7,278,353 | B2 | 10/2007 | Langan et al. | |
| 7,335,341 | B2 | 2/2008 | Van Steenkiste et al. | |
| 7,399,335 | B2 | 7/2008 | Shekhter et al. | |
| 7,402,277 | B2 | 7/2008 | Ayer et al. | |
| 7,479,299 | B2 | 1/2009 | Raybould et al. | |
| 7,514,122 | B2 | 4/2009 | Kramer | |
| 7,582,846 | B2 | 9/2009 | Molz et al. | |
| 7,618,500 | B2 | 11/2009 | Farmer et al. | |
| 7,670,406 | B2 | 3/2010 | Belashchenko | |
| 7,910,051 | B2 | 3/2011 | Zimmermann et al. | |
| 8,002,169 | B2 | 8/2011 | Miller et al. | |
| 8,043,655 | B2 | 10/2011 | Miller et al. | |
| 2001/0014568 | A1 | 8/2001 | Itoh et al. | |
| 2002/0112789 | A1 | 8/2002 | Jepson et al. | |
| 2002/0112955 | A1 | 8/2002 | Aimone et al. | |
| 2003/0023132 | A1 | 1/2003 | Melvin et al. | |
| 2003/0190413 | A1 | 10/2003 | Van Steenkiste et al. | |
| 2003/0219542 | A1 | 11/2003 | Ewasyshyn et al. | |
| 2003/0232132 | A1 | 12/2003 | Muehlberger | |
| 2004/0037954 | A1 | 2/2004 | Heinrich et al. | |
| 2004/0065546 | A1 | 4/2004 | Michaluk et al. | |
| 2004/0076807 | A1 | 4/2004 | Grinberg et al. | |
| 2004/0126499 | A1 | 7/2004 | Heinrich et al. | |
| 2004/0202885 | A1 | 10/2004 | Seth et al. | |
| 2005/0084701 | A1 | 4/2005 | Slattery | |
| 2005/0120957 | A1 | 6/2005 | Kowalsky et al. | |
| 2005/0142021 | A1 | 6/2005 | Aimone et al. | |
| 2005/0147742 | A1 | 7/2005 | Kleshock et al. | |
| 2005/0153069 | A1 * | 7/2005 | Tapphorn et al. | 427/180 |
| 2005/0155856 | A1 | 7/2005 | Oda | |
| 2005/0220995 | A1 | 10/2005 | Hu et al. | |
| 2005/0252450 | A1 | 11/2005 | Kowalsky et al. | |
| 2006/0021870 | A1 | 2/2006 | Tsai et al. | |
| 2006/0027687 | A1 | 2/2006 | Heinrich et al. | |
| 2006/0032735 | A1 | 2/2006 | Aimone et al. | |
| 2006/0042728 | A1 | 3/2006 | Lemon et al. | |
| 2006/0045785 | A1 | 3/2006 | Hu et al. | |
| 2006/0090593 | A1 | 5/2006 | Liu | |
| 2006/0121187 | A1 * | 6/2006 | Haynes et al. | 427/180 |
| 2006/0251872 | A1 | 11/2006 | Wang et al. | |
| 2007/0116886 | A1 | 5/2007 | Refke et al. | |
| 2007/0116890 | A1 | 5/2007 | Adams et al. | |
| 2007/0172378 | A1 | 7/2007 | Shibuya et al. | |
| 2007/0183919 | A1 | 8/2007 | Ayer et al. | |
| 2007/0187525 | A1 * | 8/2007 | Jabado et al. | 239/79 |
| 2007/0196570 | A1 | 8/2007 | Gentsch et al. | |
| 2008/0028459 | A1 | 1/2008 | Suh et al. | |
| 2008/0078268 | A1 | 4/2008 | Shekhter et al. | |
| 2008/0145688 | A1 | 6/2008 | Miller et al. | |
| 2008/0171215 | A1 | 7/2008 | Kumar et al. | |
| 2008/0216602 | A1 | 9/2008 | Zimmermann et al. | |
| 2008/0271779 | A1 | 11/2008 | Miller et al. | |
| 2009/0004379 | A1 | 1/2009 | Deng et al. | |
| 2009/0239754 | A1 | 9/2009 | Kruger et al. | |
| 2009/0291851 | A1 | 11/2009 | Bohn et al. | |
| 2010/0015467 | A1 | 1/2010 | Zimmermann et al. | |
| 2010/0061876 | A1 | 3/2010 | Miller et al. | |
| 2010/0084052 | A1 | 4/2010 | Farmer et al. | |
| 2010/0086800 | A1 | 4/2010 | Miller et al. | |
| 2010/0136242 | A1 | 6/2010 | Kay et al. | |
| 2010/0172789 | A1 | 7/2010 | Calla et al. | |
| 2010/0189910 | A1 | 7/2010 | Belashchenko et al. | |
| 2010/0246774 | A1 | 9/2010 | Lathrop | |
| 2010/0272889 | A1 | 10/2010 | Shekhter et al. | |
| 2011/0132534 | A1 | 6/2011 | Miller et al. | |
| 2011/0300396 | A1 | 12/2011 | Miller et al. | |
| 2011/0303535 | A1 | 12/2011 | Miller et al. | |

FOREIGN PATENT DOCUMENTS

| | | | |
|---|---|---|---|
| EP | 0074803 | A1 | 3/1983 |
| EP | 0484533 | A1 | 5/1992 |
| EP | 0774315 | A2 | 5/1997 |
| EP | 1066899 | A2 | 1/2001 |
| EP | 1138420 | A2 | 10/2001 |
| EP | 1350861 | A1 | 10/2003 |
| EP | 1382720 | A2 | 1/2004 |
| EP | 1398394 | | 3/2004 |
| EP | 1413642 | A1 | 4/2004 |
| EP | 1452622 | | 9/2004 |
| EP | 1715080 | | 10/2006 |
| GB | 2121441 | A | 12/1983 |
| GB | 2394479 | A | 4/2004 |
| JP | 54067198 | | 5/1979 |
| JP | 3197640 | | 8/1991 |
| JP | 06346232 | A | 12/1994 |
| JP | 11269639 | | 10/1999 |
| JP | 11-312484 | A | 11/1999 |
| JP | 01/131767 | | 5/2001 |
| JP | 03/301278 | | 10/2003 |
| JP | 2004-307969 | A | 11/2004 |
| JP | 2005-29858 | A | 2/2005 |
| JP | 2005-95886 | A | 4/2005 |
| RU | 2166421 | C1 | 5/2001 |
| WO | WO-98/37249 | A1 | 8/1998 |
| WO | WO-01/12364 | A1 | 2/2001 |
| WO | WO-02/064287 | A2 | 8/2002 |
| WO | WO-02/070765 | | 9/2002 |
| WO | WO-03062491 | A2 | 7/2003 |
| WO | WO-03106051 | A1 | 12/2003 |
| WO | WO-2004074540 | A1 | 9/2004 |

(56) References Cited

FOREIGN PATENT DOCUMENTS

| | | | |
|---|---|---|---|
| WO | WO-2005073418 | A1 | 8/2005 |
| WO | WO-2005/079209 | | 9/2005 |
| WO | WO-2006/117145 | | 11/2006 |
| WO | WO 2006/117145 | | 11/2006 |
| WO | WO-2007/001441 | | 1/2007 |
| WO | WO-2008/063891 | | 5/2008 |
| WO | WO-2008/089188 | A1 | 7/2008 |

OTHER PUBLICATIONS

Hall et al., "Preparation of Aluminum Coatings Containing Homogeneous Nanocrystalline Microstructures Using the Cold Spray Process," JTTEES 17:352-359.
IPRP in International Patent Application No. PCT/EP2006/003967, dated Nov. 6, 2007 (15 pages).
IPRP in International Patent Application No. PCT/US2008/062434, dated Nov. 10, 2009 (21 pages).
IPRP in International Patent Application No. PCT/EP2006/003969, mailed dated Nov. 6, 2007 (13 pages).
International Search Report and Written Opinion in International Patent Application No. PCT/US2007/087214, mailed Mar. 23, 2009 (13 pages).
IPRP in International Patent Application No. PCT/US2007/081200, dated Sep. 1, 2009 (17 pages).
IPRP in International Patent Application No. PCT/US2007/080282, dated Apr. 7, 2009 (15 pages).
Irissou et al., "Review on Cold Spray Process and Technology: Part I—Intellectual Property," 17 J. of Thermal Spray Tech. 4, pp. 495-516 (Dec. 2008).
Karthikeyan, "Cold Spray Technology: International Status and USA Efforts," ASB Industries, Inc. (Dec. 2004).
Li et al., "Effect of Annealing Treatment on the Microstructure and Properties of Cold-Sprayed Cu Coating," 15 J. of Thermal Spray Tech. 2, pp. 206-211 (Jun. 2006).
Marx et al., "Cold Spraying—Innovative Layers for New Applications," 15 J. of Thermal Spray Tech. 2, pp. 177-183 (Jun. 2006).
Morito, "Preparation and Characterization of Sintered Mo—Re Alloys," 3 J. de Physique 7, Part 1, pp. 553-556 (1993).
Search Report in European Patent Application No. 09172234.8, dated Jan. 29, 2010 (7 pages).
Stoltenhoff et al., "An Analysis of the Cold Spray Process and its Coatings," 11 J. of Thermal Spray Tech. 4, pp. 542-550 (Dec. 2002).
Van Steenkiste et al., "Analysis of Tantalum Coatings Produced by the Kinetic Spray Process," 13 J. of Thermal Spray Tech. 2, pp. 265-273 (Jun. 2004).
Kosarev et al., "Recently Patent Facilities and Applications in Cold Spray Engineering," Recent Patents on Engineering, vol. 1 pp. 35-42 (2007).
Examination Report in European Patent Application No. 07843733.2, mailed Nov. 30, 2010 (9 pages).
English Translation of Office Action mailed Feb. 23, 2011 for Chinese Patent Application No. 200880023411.5 (7 pages).
Examination Report in European Patent Application No. 08755010.9, mailed Sep. 16, 2011 (3 pages).
Examination Report in Canadian Patent Application No. 2,736,876, mailed Feb. 29, 2012 (4 pages).
Tapphorn et al., "The Solid-State Spray Forming of Low-Oxide Titanium Components," JOM, p. 45-47 (1998).

* cited by examiner

METHOD FOR COATING A SUBSTRATE SURFACE AND COATED PRODUCT

CROSS-REFERENCE TO RELATED APPLICATIONS

This application is a national stage application, under 35 U.S.C. §371, of PCT/EP2006/003967, filed Apr. 28, 2005, which claims priority to U.S. Provisional Application No. 60/678,057, filed May 5, 2005.

BACKGROUND OF THE INVENTION

The present invention relates to a method of applying coatings which contain only small amounts of gaseous impurities, in particular oxygen.

The application of refractory metal coatings to surfaces exhibits numerous problems.

In conventional processes, the metal is completely or partially melted in most cases, as a result of which the metals readily oxidise or absorb other gaseous impurities. For this reason, conventional processes such as deposition-welding and plasma spraying must be carried out under a protecting gas or in vacuo.

In such cases, the outlay in terms of apparatus is high, the size of the components is limited, and the content of gaseous impurities is still unsatisfactory.

The pronounced introduction of heat transmitted into the object to be coated leads to a very high potential for distortion and means that these processes cannot be employed in the case of complex components, which often also contain constituents that melt at low temperatures. Complex components must therefore be taken apart before they are re-processed, with the result, in general, that re-processing is scarcely economical and only recycling of the material of the components (scrapping) is carried out.

Moreover, in the case of vacuum plasma spraying, tungsten and copper impurities, which originate from the electrodes used, are introduced into the coating, which is generally undesirable. In the case of, for example, the use of tantalum or niobium coatings for corrosion protection, such impurities reduce the protective effect of the coating by the formation of so-called micro-galvanic cells.

Moreover, such processes are processes of melt metallurgy, which always involve the inherent disadvantages thereof, such as, for example, unidirectional grain growth. This occurs in particular in laser processes, where a suitable powder is applied to the surface and melted by means of a laser beam. A further problem is the porosity, which can be observed in particular when a metal powder is first applied and is subsequently melted by means of a heat source. Attempts have been made in WO 02/064287 to solve these problems by merely melting on the powder particles by means of an energy beam, such as, for example, laser beams, and sintering them. However, the results are not always satisfactory and a high outlay in terms of apparatus is required, and the problems associated with the introduction of a reduced but nevertheless high amount of energy into a complex component remain.

WO-A-03/106,051 discloses a method and an apparatus for low pressure cold spraying. In this process a coating of powder particles is sprayed in a gas substantially at ambient temperatures onto a workpiece. The process is conducted in a low ambient pressure environment which is less than atmospheric pressure to accelerate the sprayed powder particles. With this process a coating of a powder is formed on a workpiece.

EP-A-1,382,720 discloses another method and apparatus for low pressure cold spraying. In this process the target to be coated and the cold spray gun are located within a vacuum chamber at pressures below 80 kPa. With this process a workpiece is coated with a powder.

BRIEF SUMMARY OF THE INVENTION

In view of this prior art it was therefore the object, to provide a novel process for coating substrates which is distinguished by the introduction of a small amount of energy, a low outlay in terms of apparatus and broad applicability for different carrier materials and coating materials, and wherein the metal to be applied is not melted on during processing.

Another object of this invention was the provision of a novel process for preparing dense and corrosion resistant coatings, especially tantalum coatings, which possess low content of impurities, preferably low content of oxygen and nitrogen impurities, which coatings are highly qualified for use as corrosion protective layer, especially in equipment of chemical plants.

The object of the present invention is achieved by applying a desired refractory metal to the desired surface by a method as claimed in claim 1.

There are generally suitable for this purpose processes in which, in contrast to the conventional processes of thermal spraying (flame, plasma, high-velocity flame, arc, vacuum plasma, low-pressure plasma spraying) and of deposition-welding, there is no melting on of the coating material, caused by thermal energy produced in the coating apparatus. Contact with a flame or hot combustion gases is to be avoided, because these can cause oxidation of the powder particles and hence the oxygen content in the resulting coatings rises.

These processes are known to the person skilled in the art as, for example, cold gas spraying, cold spray processes, cold gas dynamic spraying, kinetic spraying and are described, for example, in EP-A-484533. Also suitable according to the invention is the process described in patent DE-A-10253794.

The so-called cold spray process or the kinetic spray process are particularly suitable for the method according to the invention; the cold spray process, which is described in EP-A-484533, is especially suitable, and this specification is incorporated herein by reference.

A BRIEF DESCRIPTION OF THE FIGURES

FIG. 1: Unetched cross-section of a tantalum coating, process gas helium.

Figure 2:
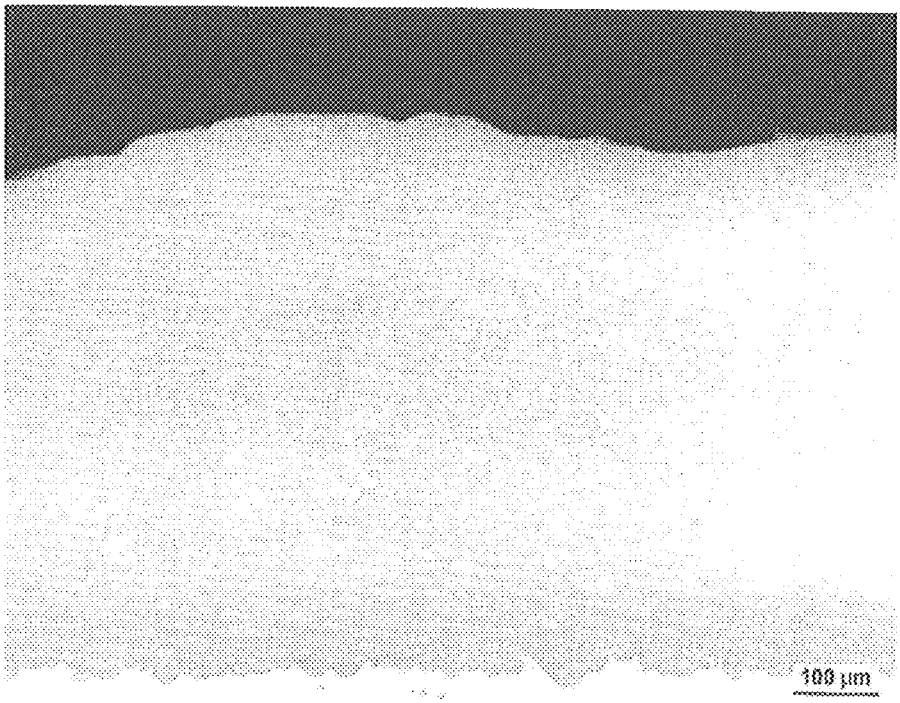

FIG. 2: Unetched cross-section of a tantalum coating, process gas helium, overview picture with low magnification.

Figure 3:
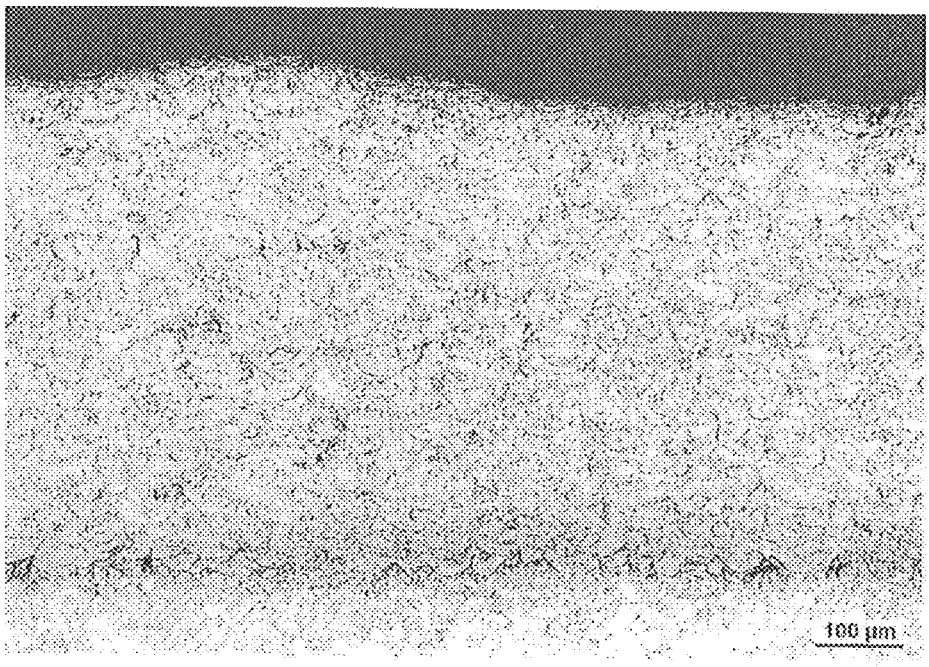

FIG. 3: Cross-section of a tantalum coating, etched with hydrofluoric acid, process gas helium, overview picture with low magnification.

Figure 4:
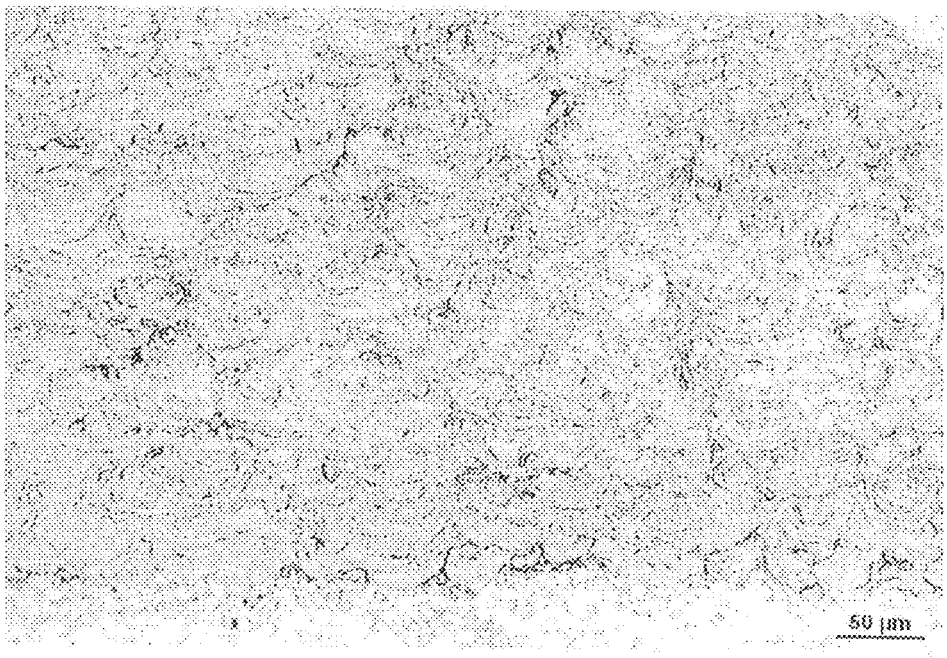

FIG. 4: Cross-section of a tantalum coating, etched with hydrofluoric acid, process gas helium.

Figure 5:
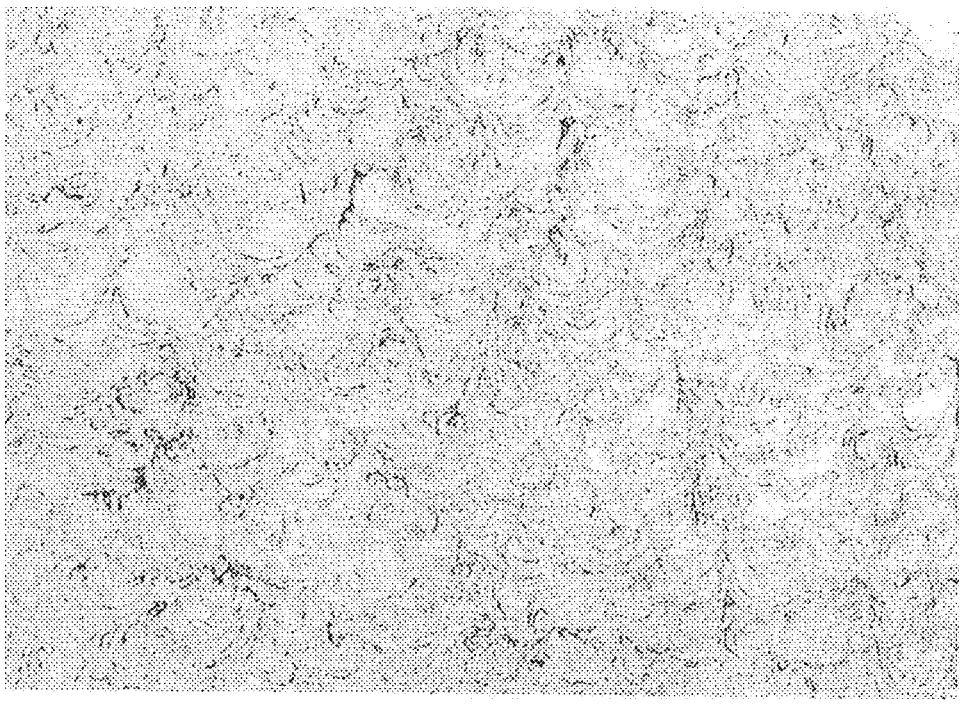

FIG. 5: Image section used for porosity determination, cross-section of a tantalum coating, process gas helium.

Figure 6:
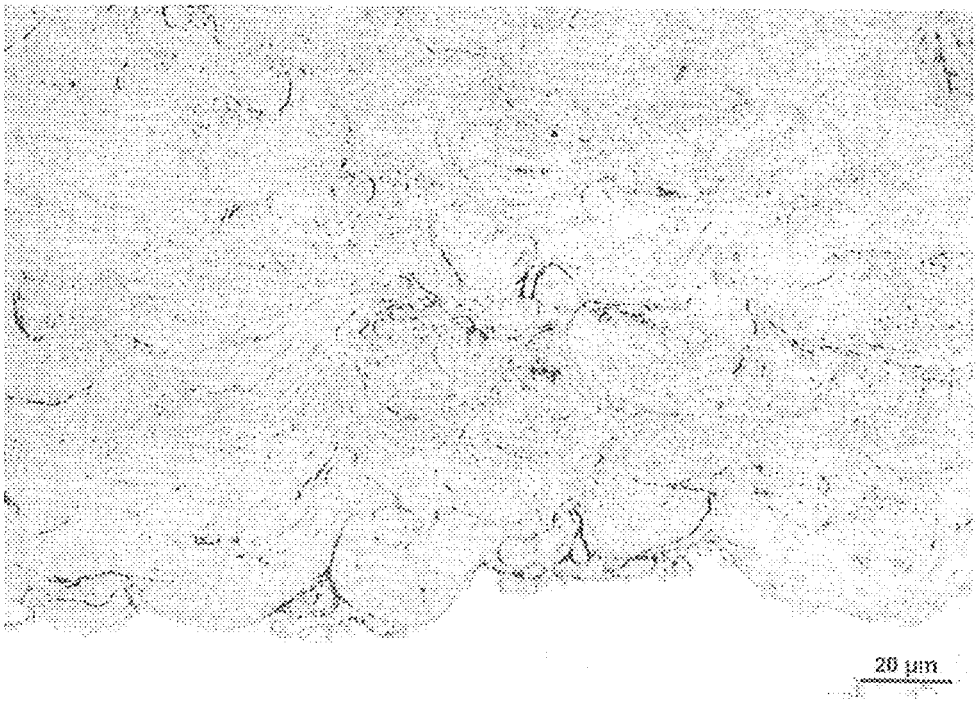

FIG. 6: Cross-section of a tantalum coating, etched with hydrofluoric acid, interface with the substrate, process gas helium.

Figure 7:
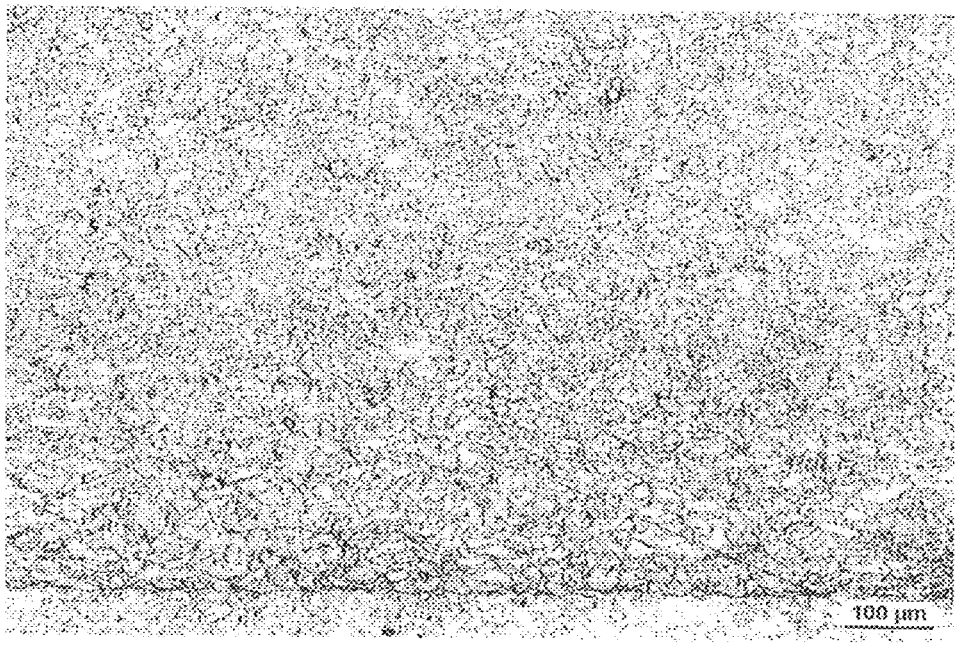

FIG. 7: Unetched cross-section of a tantalum coating, process gas nitrogen, overview picture with low magnification.

Figure 8:
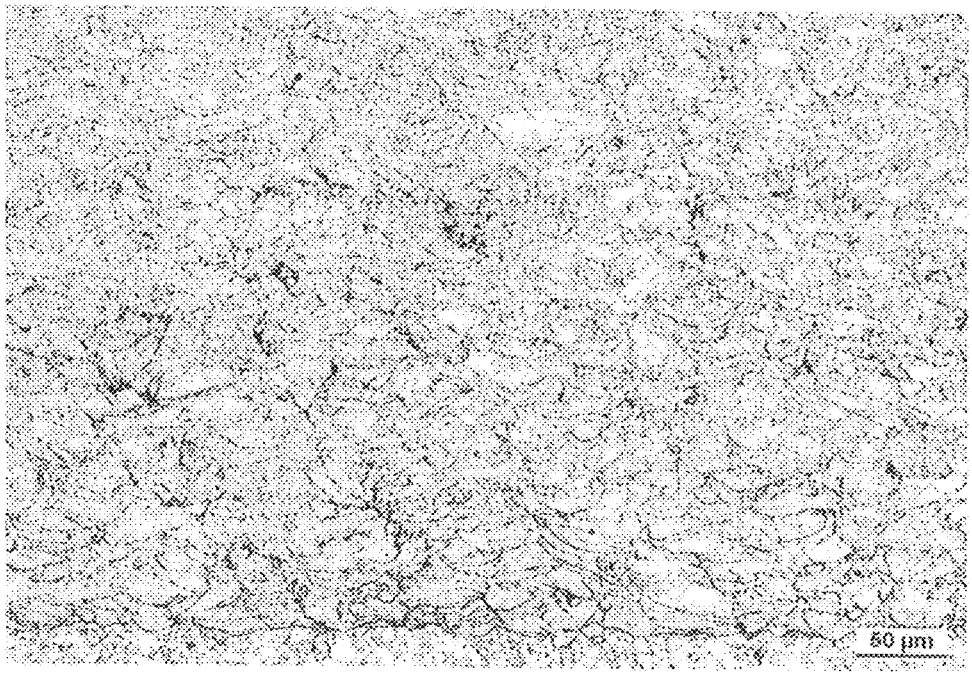

FIG. 8: Unetched cross-section of a tantalum coating, process gas nitrogen.

Figure 9:
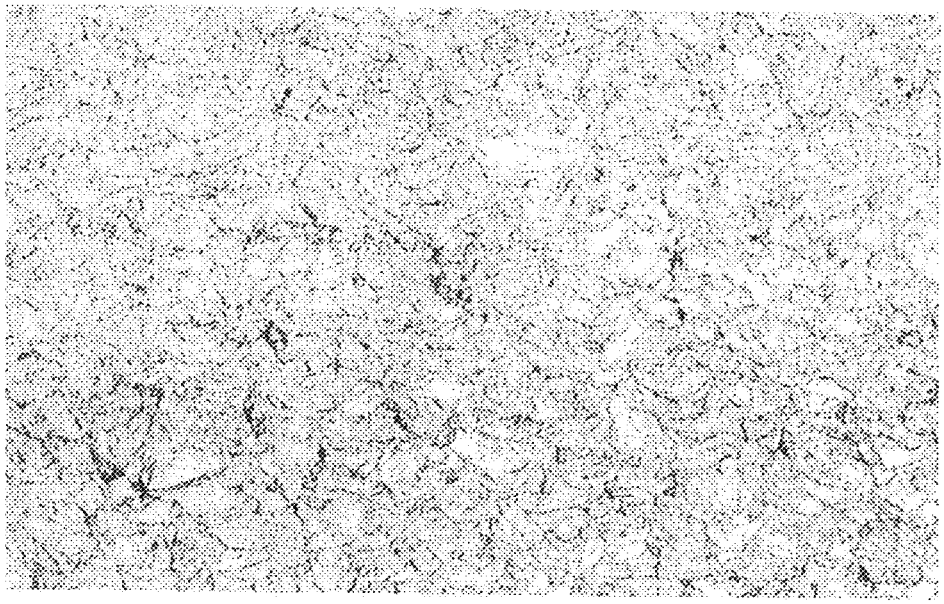

FIG. 9: Image section used for porosity determination, cross-section of a tantalum coating, process gas nitrogen.

Figure 10:
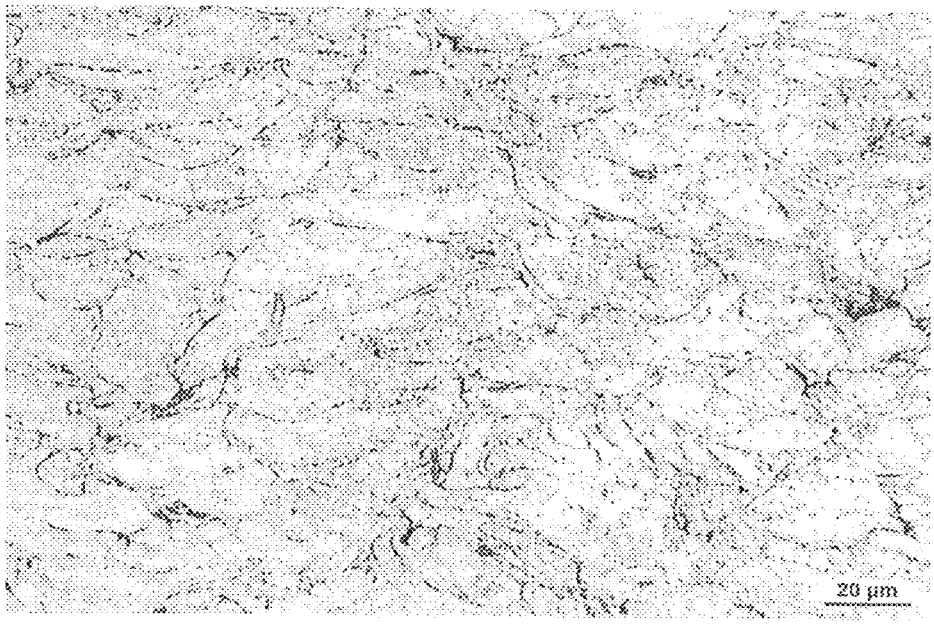

FIG. 10: Unetched cross-section of a tantalum coating, process gas nitrogen, high magnification.

DETAILED DESCRIPTION OF THE INVENTION

Accordingly, there is advantageously employed a method for applying coatings to surfaces, wherein a gas flow forms a gas-powder mixture with a powder of a material selected from the group consisting of niobium, tantalum, tungsten, molybdenum, titanium, zirconium, mixtures of at least two thereof or their alloys with one another or with other metals, the powder has a particle size of from 0.5 to 150 μm, wherein a supersonic speed is imparted to the gas flow and a jet of supersonic speed is formed, which ensures a speed of the powder in the gas-powder mixture of from 300 to 2000 m/s, preferably from 300 to 1200 m/s, and the jet is directed onto the surface of an object.

The metal powder particles striking the surface of the object form a coating, the particles being deformed very considerably.

The powder particles are advantageously present in the jet in an amount that ensures a flow rate density of the particles of from 0.01 to 200 g/s $cm^2$, preferably 0.01 to 100 g/s $cm^2$, very preferably 0.01 g/s $cm^2$ to 20 g/s $cm^2$, or most preferred from 0.05 g/s $cm^2$ to 17 g/s $cm^2$.

The flow rate density is calculated according to the formula $F=m/(\pi/4*D^2)$ where F=flow rate density, D=nozzle cross-section, m=powder feed rate. A powder feed rate of, for example, 70 g/min=1.1667 g/s is a typical example of a powder feed rate.

At low D values of below 2 mm values of markedly greater than 20 g/s $cm^2$ can be achieved. In this case F can easily assume values 50 g/s $cm^2$ or even higher at higher powder delivery rates.

As the gas with which the metal powder forms a gas-powder mixture there is generally used an inert gas such as argon, neon, helium, nitrogen or mixtures of two or more thereof. In particular cases, air may also be used. If safety regulations are met also use of hydrogen or mixtures of hydrogen with other gases can be used.

In a preferred version of the process the spraying comprises the steps of:

- providing a spraying orifice adjacent a surface to be coated by spraying;
- providing to the spraying orifice a powder of a particulate material chosen from the group consisting of niobium, tantalum, tungsten, molybdenum, titanium, zirconium, mixtures of at least two thereof or alloys thereof with one another or other metals, the powder having a particle size of 0.5 to 150 μm, said powder being under pressure;
- providing an inert gas under pressure to the spraying orifice to establish a static pressure at the spraying orifice and providing a spray of said particulate material and gas onto the surface to be coated; and
- locating the spraying orifice in a region of low ambient pressure which is less than 1 atmosphere and which is substantially less than the static pressure at the spraying orifice to provide substantial acceleration of the spray of said particulate material and gas onto said surface to be coated.

In another preferred version of the process the spraying is performed with a cold spray gun and the target to be coated and the cold spray gun are located within a vacuum chamber at pressures below 80 kPa, preferably between 0.1 and 50 kPa, and most preferred between 2 and 10 kPa. Further advantageous embodiments can be found in the claims.

In general, the refractory metal has a purity of 99% or more, such as 99.5% or 99.7% or 99.9%.

According to the invention, the refractory metal advantageously has a purity of at least 99.95%, based on metallic impurities, especially of at least 99.995% or of at least 99.999%, in particular of at least 99.9995%. If an alloy is used instead of a single refractory metal, then at least the refractory metal, but preferably the alloy as a whole, has that purity, so that a corresponding highly pure coating can be produced.

In addition, the metal powder has an oxygen content of less than 1000 ppm oxygen, or less than 500, or less than 300, in particular an oxygen content of less than 100 ppm.

Particularly suitable refractory metal powders have a purity of at least 99.7%, advantageously of at least 99.9%, in particular 99.95%, and a content of less than 1000 ppm oxygen, or less than 500 ppm oxygen, or less than 300 ppm oxygen, in particular an oxygen content of less than 100 ppm.

Particularly suitable refractory metal powders have a purity of at least 99.95%, in particular of at least 99.995%, and a content of less than 1000 ppm oxygen, or less than 500 ppm oxygen, or less than 300 ppm oxygen, in particular an oxygen content of less than 100 ppm.

Particularly suitable refractory metal powders have a purity of at least 99.999%, in particular of at least 99.9995%, and a content of less than 1000 ppm oxygen, or less than 500 ppm oxygen, or less than 300 ppm oxygen, in particular an oxygen content of less than 100 ppm.

In all the above-mentioned powders, the total content of other non-metallic impurities, such as carbon, nitrogen or hydrogen, should advantageously be less than 500 ppm, preferably less than 150 ppm.

In particular, the oxygen content is advantageously 50 ppm or less, the nitrogen content is 25 ppm or less and the carbon content is 25 ppm or less.

The content of metallic impurities is advantageously 500 ppm or less, preferably 100 ppm or less and most preferably 50 ppm or less, in particular 10 ppm or less.

Suitable metal powders are, for example, many of the refractory metal powders which are also suitable for the production of capacitors.

Such metal powders can be prepared by reduction of refractory metal compound with a reducing agent and preferably subsequent deoxidation. Tungsten oxide or molybdenum oxide, for example, is reduced in a stream of hydrogen at elevated temperature. The preparation is described, for example, in Schubert, Lassner, "Tungsten", Kluwer Academic/Plenum Publishers, New York, 1999 or Brauer, "Handbuch der Präparativen Anorganischen Chemie", Ferdinand Enke Verlag Stuttgart, 1981, p 1530.

In the case of tantalum and niobium, the preparation is in most cases carried out by reducing alkali heptafluoro-tantalates and earth alkaline metal heptafluoro-tantalates or the oxides, such as, for example, sodium heptafluorotantalate, potassium heptafluorotantalate, sodium heptafluoroniobate or potassium heptafluoroniobate, with an alkali or alkaline earth metal. The reduction can be carried out in a salt melt with the addition of, for example, sodium, or in the gas phase, calcium or magnesium vapour advantageously being used. It is also possible to mix the refractory metal compound with the alkali or alkaline earth metal and heat the mixture. A hydrogen atmosphere may be advantageous. A large number of suitable processes is known to the person skilled in the art, as are process parameters from which suitable reaction conditions can be selected. Suitable processes are described, for example, in U.S. Pat. No. 4,483,819 and WO 98/37249.

After the reduction, deoxidation is preferably carried out. This can be effected, for example, by mixing the refractory metal powder with Mg, Ca, Ba, La, Y or Ce and then heating, or by heating the refractory metal in the presence of a getter in an atmosphere that allows oxygen to pass from the metal powder to the getter. The refractory metal powder is in most cases then freed of the salts of the deoxidising agent using an acid and water, and is dried.

It is advantageous if, when using metals to lower the oxygen content, the metallic impurities can be kept low. A further process for preparing pure powder having a low oxygen content consists in reducing a refractory metal hydride using an alkaline earth metal as reducing agent, as disclosed, for example, in WO 01/12364 and EP-A-1200218.

The thickness of the coating is usually more than 0.01 mm. Preferred are layers with a thickness between 0.05 and 10 mm, more preferred between 0.05 and 5 mm, still more preferred between 0.05 and 1 mm, still more preferred between 0.05 and 0.5 mm. The thickness may be higher as well, for example from 3 to 50 mm, or from 5 to 45 mm, or from 8 to 40 mm, or from 10 to 30 mm or from 10 to 20 mm or 10 to 15 mm.

The purities and oxygen contents of the resulting coatings should deviate not more than 50% and preferably not more than 20% from those of the powder.

Advantageously, this can be achieved by coating the substrate surface under an inert gas. Argon is advantageously used as the inert gas because, owing to its higher density than air, it tends to cover the object to be coated and to remain present, in particular when the surface to be coated is located in a vessel which prevents the argon from escaping or flowing away and more argon is continuously added.

The coatings applied according to the invention have a high purity and a low oxygen content. Advantageously, these coatings have an oxygen content of less than 1000 ppm oxygen, or less than 500, or less than 300, in particular an oxygen content of less than 100 ppm.

The coatings usually exhibit compressive stress $\sigma$. Usually, the compressive stress is about −1000 MPa to 0 MPa, or from −700 MPa to 0 MPa, or from −500 MPa to 0 MPa, of from −400 MPa to 0 MPa or from −300 MPa to 0. More specifically, the compressive stress is from −200 MPa to −1000 MPa, or from −300 MPa to −700 MPa, or from −300 MPa to −500 MPa.

In general, a lower oxygen content of the powder employed will result in layers exhibiting lower compressive stress, e.g. a layer sprayed from powder having an oxygen content of 1400 ppm will usually result in a layer exhibiting compressive stress of about −970±50 MPa and a layer sprayed from powder having an oxygen content of 270 ppm will usually result in a layer exhibiting compressive stress of about −460 MPa±50 MPa, more preferably −400 MPa±50 MPa.

In contrast thereto, layers produced by plasma spraying result in layers exhibiting no compressive stress at all, but tensile stress.

In particular, these coatings have a purity of at least 99.7%, advantageously of at least 99.9%, in particular of at least 99.95%, and a content of less than 1000 ppm oxygen, or less than 500 ppm oxygen, or less than 300 ppm oxygen, in particular an oxygen content of less than 100 ppm.

In particular, these coatings have a purity of at least 99.95%, in particular of at least 99.995%, and a content bf less than 1000 ppm oxygen, or less than 500 ppm oxygen, or less than 300 ppm oxygen, in particular an oxygen content of less than 100 ppm.

In particular, these coatings have a purity of 99.999%, in particular of at least 99.9995%, and a content of less than 1000 ppm oxygen, or less than 500 ppm oxygen, or less than 300 ppm oxygen, in particular an oxygen content of less than 100 ppm.

The coatings according to the invention have a total content of other non-metallic impurities, such as carbon, nitrogen or hydrogen, which is advantageously below 500 ppm and most preferably below 150 ppm.

The applied coating has a content of gaseous impurities which differs by not more than 50%, or not more than 20%, or not more than 10%, or not more than 5%, or not more than 1%, from the content of the starting powder with which this coating was produced. The term "differs" is to be understood as meaning in particular an increase; the resulting coatings should, therefore, advantageously have a content of gaseous impurities that is not more than 50% greater than the content of the starting powder.

The applied coating preferably has an oxygen content which differs by not more than 5%, in particular not more than 1%, from the oxygen content of the starting powder.

The coatings according to the invention preferably have a total content of other non-metallic impurities, such as carbon, nitrogen or hydrogen, which is advantageously less than 500 ppm and most preferably less than 150 ppm. With the process of this invention layers with higher impurity contents can also be produced.

In particular, the oxygen content is advantageously 50 ppm or less, the nitrogen content is 25 ppm or less and the carbon content is 25 ppm or less.

The content of metallic impurities is advantageously 50 ppm or less, in particular 10 ppm or less.

In an advantageous embodiment, the coatings additionally have a density of at least 97%, preferably greater than 98%, in particular greater than 99% or 99.5%. 97% density of a layer means that the layer has a density of 97% of the bulk material. The density of the coating is here a measure of the closed nature and porosity of the coating. A closed, substantially pore-free coating always has a density of more than 99.5%. The density can be determined either by image analysis of a cross-sectional image (ground section) of such a coating, or alternatively by helium pycnometry. The latter method is less preferred because, in the case of very dense coatings, pores present in coatings that are more remote from the surface are not detected and a lower porosity is accordingly measured than actually exists. By means of image analysis, the density can be determined by first determining the total area of the coating to be investigated in the image area of the microscope and relating this area to the areas of the pores. In this method, pores that are located far from the surface and close to the interface with the substrate are also detected. A high density of at least 97%, preferably greater than 98%, in particular greater than 99% or 99.5%, is important in many coating processes.

The coatings show high mechanical strength which is caused by their high density and by the high deformation of the particles. In the case of tantalum, therefore, the strengths are at least 80 MPa more preferably at least 100 MPa, most preferably at least 140 MPa when nitrogen is used as the gas with which the metal powder forms a gas-powder mixture. If helium is used, the strength usually is at least 150 MPa, preferably at least 170 MPa, most preferably at least 200 MPa and very most preferred greater than 250 MPa.

Although the coatings according to the invention show high densities and low porosities, the coatings have a morphology clearly showing it was created from discrete particles. Examples can be seen, for example, in FIGS. 1 to 7. In this way the coatings according to the invention can be distinguished over coatings obtained by other methods, like coatings obtained by galvanic processes. The characteristic appearance also allows distinguishing of coatings according to the invention from coatings obtained by plasma spraying.

The articles to be coated with the process of this invention are not limited. Generally all articles which need a coating, preferably a corrosion protective coating, can be used. These articles may be made of metal and/or of ceramic material and/or of plastic material or may comprise components from these materials. Preferably surfaces of materials are coated which are subject to removal of material, for example by wear, corrosion, oxidation, etching, machining or other stress.

Preferably surfaces of materials are coated with the process of this invention which are used in corroding surroundings, for example in chemical processes in medical devices or in implants. Examples of apparatus or components to be coated are components used in chemical plants or in laboratories or in medical devices or as implants, such as reaction and mixing vessels, stirrers, blind flanges, thermowells, birsting disks, birsting disk holders, heat exchangers (shell and tubes), pipings, valves, valve bodies and pump parts.

Preferably articles are coated with the process of this invention which are no sputter targets or X-ray anodes.

The coatings prepared with the process of this invention preferably are used in corrosion protection.

The present invention therefore relates also to articles made of metal and/or of ceramic material and/or of plastic material containing at least one coatings composed of the refractory metals niobium, tantalum, tungsten, molybdenum, titanium zirconium or mixtures of two or more thereof or alloys of two or more thereof or alloys with other metals, which coatings have the above-mentioned properties.

Such coatings are in particular coatings of tantalum or niobium.

Preferably layers of tungsten, molybdenum, titanium zirconium or mixtures of two or more thereof or alloys of two or more thereof or alloys with other metals, very preferably layers of tantalum or niobium, are applied by cold spraying to the surface of a substrate to be coated. Surprisingly it has been found that with said powders or powder mixtures, preferably with tantalum and niobium powders, possessing a reduced oxygen content, for example an oxygen content below 1000 ppm, there can be produced cold sprayed layers with very high deposition rates of more than 90%. In said cold sprayed layers the oxygen content of the metal is nearly unchanged compared to the oxygen content of the powders. These cold sprayed layers show considerably higher densities than layers produced by plasma spraying or by vacuum spraying. Furthermore, these cold sprayed layers can be produced without any or with small texture, depending on powder properties and coating parameters. These cold sprayed layers are also object of this invention.

Suitable metal powders for use in the methods according to the invention are also metal powders that consist of alloys, pseudo alloys and powder mixtures of refractory metals with suitable non-refractory metals.

It is thereby possible to coat surfaces of substrates made of the same alloy or pseudo alloy.

These include especially alloys, pseudo alloys or powder mixtures of a refractory metal selected from the group consisting of niobium, tantalum, tungsten, molybdenum, titanium, zirconium or mixtures of two or more thereof, with a metal selected from the group cobalt, nickel, rhodium, palladium, platinum, copper, silver and gold. Such powders belong to the prior art, are known in principle to the person skilled in the art and are described, for example, in EP-A-774315 and EP-A-1138420.

They can be prepared by conventional processes; for example, powder mixtures are obtainable by homogenously mixing pre-prepared metal powders, it being possible for the mixing to be carried out on the one hand before use in the method according to the invention or alternatively during production of the gas-powder mixture. Alloy powders are in most cases obtainable by melting and mixing the alloying partners. According to the invention there may be used as alloy powders also so-called pre-alloyed powders. These are powders which are produced by mixing compounds such as, for example, salts, oxides and/or hydrides of the alloying partners and then reducing them, so that intimate mixtures of the metals in question are obtained. It is additionally possible according to the invention to use pseudo alloys. Pseudo alloys are understood as being materials which are obtained not by conventional melt metallurgy but, for example, by grinding, sintering or infiltration.

Known materials are, for example, tungsten/copper alloys or tungsten/copper mixtures, the properties of which are known and are listed here by way of example:

| Type | Density ($g/cm^3$) | HB (MPa) | Electrical conductivity (% IACS) | Thermal expansion coefficient (ppm/K) | Thermal conductivity (W/m · K) |
|---|---|---|---|---|---|
| WCu10 | 16.8-17.2 | ≥2550 | >27 | 6.5 | 170-180 |
| WCu15 | 16.3 | | | 7.0 | 190-200 |
| WCu20 | 15.2-15.6 | ≥2160 | >34 | 8.3 | 200-220 |
| WCu25 | 14.5-15.0 | ≥1940 | >38 | 9.0 | 220-250 |
| WCu30 | 13.8-14.4 | ≥1720 | >42 | | |

Also known are molybdenum-copper alloys or molybdenium/copper mixtures in the same ratios as indicated above.

Also known are molybdenum-silver alloys or molybdenium/silver mixtures which contain, for example, 10, 40 or 65 wt. % molybdenum.

Also known are tungsten-silver alloys or tungsten/silver mixtures which contain, for example, 10, 40 or 65 wt. % tungsten.

These can be used, for example, in heat pipes, cooling bodies or, in general, in temperature management systems.

It is also possible to use tungsten-rhenium alloys or mixtures, or the metal powder is an alloy having the following composition:

from 94 to 99 wt. %, preferably from 95 to 97 wt. %, molybdenum, from 1 to 6 wt. %, preferably from 2 to 4 wt. %, niobium, from 0.05 to 1 wt. %, preferably from 0.05 to 0.02 wt. %, zirconium.

These alloys, like pure refractory metal powders having a purity of at least 99.95%, can be used in the recycling or production of sputter targets by means of cold gas spraying.

Suitable materials for the methods according to the invention are listed in Tables 1 to 15. Individual materials are designated with the number of the table followed by the number of the combination of components and the amount of the non-refractory metal as in Table 1. For example, material 2.005 is a material described in Table 2, the precise composition being defined with the non-refractory metal and the amount thereof as listed in Table 1, position no. 5.

Suitable niobium alloys are listed in Table 1.

TABLE 1

| No. | Refractory metal | Non-refractory metal | Amount of non-refractory metal (wt. %) |
|---|---|---|---|
| 1.001 | Niobium | Cobalt | 2-5 |
| 1.002 | Niobium | Nickel | 2-5 |
| 1.003 | Niobium | Rhodium | 2-5 |
| 1.004 | Niobium | Palladium | 2-5 |
| 1.005 | Niobium | Platinum | 2-5 |
| 1.006 | Niobium | Copper | 2-5 |
| 1.007 | Niobium | Silver | 2-5 |
| 1.008 | Niobium | Gold | 2-5 |
| 1.009 | Niobium | Cobalt | 5-10 |
| 1.010 | Niobium | Nickel | 5-10 |
| 1.011 | Niobium | Rhodium | 5-10 |
| 1.012 | Niobium | Palladium | 5-10 |
| 1.013 | Niobium | Platinum | 5-10 |
| 1.014 | Niobium | Copper | 5-10 |
| 1.015 | Niobium | Silver | 5-10 |
| 1.016 | Niobium | Gold | 5-10 |
| 1.017 | Niobium | Cobalt | 10-15 |
| 1.018 | Niobium | Nickel | 10-15 |
| 1.019 | Niobium | Rhodium | 10-15 |
| 1.020 | Niobium | Palladium | 10-15 |
| 1.021 | Niobium | Platinum | 10-15 |
| 1.022 | Niobium | Copper | 10-15 |
| 1.023 | Niobium | Silver | 10-15 |
| 1.024 | Niobium | Gold | 10-15 |
| 1.025 | Niobium | Cobalt | 15-20 |
| 1.026 | Niobium | Nickel | 15-20 |
| 1.027 | Niobium | Rhodium | 15-20 |
| 1.028 | Niobium | Palladium | 15-20 |
| 1.029 | Niobium | Platinum | 15-20 |
| 1.030 | Niobium | Copper | 15-20 |
| 1.031 | Niobium | Silver | 15-20 |
| 1.032 | Niobium | Gold | 15-20 |
| 1.033 | Niobium | Cobalt | 20-25 |
| 1.034 | Niobium | Nickel | 20-25 |
| 1.035 | Niobium | Rhodium | 20-25 |
| 1.036 | Niobium | Palladium | 20-25 |
| 1.037 | Niobium | Platinum | 20-25 |
| 1.038 | Niobium | Copper | 20-25 |
| 1.039 | Niobium | Silver | 20-25 |
| 1.040 | Niobium | Gold | 20-25 |
| 1.041 | Niobium | Cobalt | 25-30 |
| 1.042 | Niobium | Nickel | 25-30 |
| 1.043 | Niobium | Rhodium | 25-30 |
| 1.044 | Niobium | Palladium | 25-30 |
| 1.045 | Niobium | Platinum | 25-30 |
| 1.046 | Niobium | Copper | 25-30 |
| 1.047 | Niobium | Silver | 25-30 |
| 1.048 | Niobium | Gold | 25-30 |

Table 2: Table 2 consists of 48 alloys, the refractory metal being tantalum instead of niobium and the non-refractory metal and the amount thereof in wt. % being as indicated in Table 1.

TABLE 2

| No. | Refractory metal | Non-refractory metal | Amount of non-refractory metal (wt. %) |
|---|---|---|---|
| 2.001 | Tantalum | Cobalt | 2-5 |
| 2.002 | Tantalum | Nickel | 2-5 |
| 2.003 | Tantalum | Rhodium | 2-5 |
| 2.004 | Tantalum | Palladium | 2-5 |
| 2.005 | Tantalum | Platinum | 2-5 |
| 2.006 | Tantalum | Copper | 2-5 |
| 2.007 | Tantalum | Silver | 2-5 |
| 2.008 | Tantalum | Gold | 2-5 |
| 2.009 | Tantalum | Cobalt | 5-10 |
| 2.010 | Tantalum | Nickel | 5-10 |
| 2.011 | Tantalum | Rhodium | 5-10 |

TABLE 2-continued

| No. | Refractory metal | Non-refractory metal | Amount of non-refractory metal (wt. %) |
|---|---|---|---|
| 2.012 | Tantalum | Palladium | 5-10 |
| 2.013 | Tantalum | Platinum | 5-10 |
| 2.014 | Tantalum | Copper | 5-10 |
| 2.015 | Tantalum | Silver | 5-10 |
| 2.016 | Tantalum | Gold | 5-10 |
| 2.017 | Tantalum | Cobalt | 10-15 |
| 2.018 | Tantalum | Nickel | 10-15 |
| 2.019 | Tantalum | Rhodium | 10-15 |
| 2.020 | Tantalum | Palladium | 10-15 |
| 2.021 | Tantalum | Platinum | 10-15 |
| 2.022 | Tantalum | Copper | 10-15 |
| 2.023 | Tantalum | Silver | 10-15 |
| 2.024 | Tantalum | Gold | 10-15 |
| 2.025 | Tantalum | Cobalt | 15-20 |
| 2.026 | Tantalum | Nickel | 15-20 |
| 2.027 | Tantalum | Rhodium | 15-20 |
| 2.028 | Tantalum | Palladium | 15-20 |
| 2.029 | Tantalum | Platinum | 15-20 |
| 2.030 | Tantalum | Copper | 15-20 |
| 2.031 | Tantalum | Silver | 15-20 |
| 2.032 | Tantalum | Gold | 15-20 |
| 2.033 | Tantalum | Cobalt | 20-25 |
| 2.034 | Tantalum | Nickel | 20-25 |
| 2.035 | Tantalum | Rhodium | 20-25 |
| 2.036 | Tantalum | Palladium | 20-25 |
| 2.037 | Tantalum | Platinum | 20-25 |
| 2.038 | Tantalum | Copper | 20-25 |
| 2.039 | Tantalum | Silver | 20-25 |
| 2.040 | Tantalum | Gold | 20-25 |
| 2.041 | Tantalum | Cobalt | 25-30 |
| 2.042 | Tantalum | Nickel | 25-30 |
| 2.043 | Tantalum | Rhodium | 25-30 |
| 2.044 | Tantalum | Palladium | 25-30 |
| 2.045 | Tantalum | Platinum | 25-30 |
| 2.046 | Tantalum | Copper | 25-30 |
| 2.047 | Tantalum | Silver | 25-30 |
| 2.048 | Tantalum | Gold | 25-30 |

Table 3: Table 3 consists of 48 alloys, the refractory metal being tungsten instead of niobium and the non-refractory metal and the amount thereof in wt. % being as indicated in Table 1.

TABLE 3

| No. | Refractory metal | Non-refractory metal | Amount of non-refractory metal (wt. %) |
|---|---|---|---|
| 3.001 | Tungsten | Cobalt | 2-5 |
| 3.002 | Tungsten | Nickel | 2-5 |
| 3.003 | Tungsten | Rhodium | 2-5 |
| 3.004 | Tungsten | Palladium | 2-5 |
| 3.005 | Tungsten | Platinum | 2-5 |
| 3.006 | Tungsten | Copper | 2-5 |
| 3.007 | Tungsten | Silver | 2-5 |
| 3.008 | Tungsten | Gold | 2-5 |
| 3.009 | Tungsten | Cobalt | 5-10 |
| 3.010 | Tungsten | Nickel | 5-10 |
| 3.011 | Tungsten | Rhodium | 5-10 |
| 3.012 | Tungsten | Palladium | 5-10 |
| 3.013 | Tungsten | Platinum | 5-10 |
| 3.014 | Tungsten | Copper | 5-10 |
| 3.015 | Tungsten | Silver | 5-10 |
| 3.016 | Tungsten | Gold | 5-10 |
| 3.017 | Tungsten | Cobalt | 10-15 |
| 3.018 | Tungsten | Nickel | 10-15 |
| 3.019 | Tungsten | Rhodium | 10-15 |
| 3.020 | Tungsten | Palladium | 10-15 |
| 3.021 | Tungsten | Platinum | 10-15 |
| 3.022 | Tungsten | Copper | 10-15 |
| 3.023 | Tungsten | Silver | 10-15 |
| 3.024 | Tungsten | Gold | 10-15 |

TABLE 3-continued

| No. | Refractory metal | Non-refractory metal | Amount of non-refractory metal (wt. %) |
|---|---|---|---|
| 3.025 | Tungsten | Cobalt | 15-20 |
| 3.026 | Tungsten | Nickel | 15-20 |
| 3.027 | Tungsten | Rhodium | 15-20 |
| 3.028 | Tungsten | Palladium | 15-20 |
| 3.029 | Tungsten | Platinum | 15-20 |
| 3.030 | Tungsten | Copper | 15-20 |
| 3.031 | Tungsten | Silver | 15-20 |
| 3.032 | Tungsten | Gold | 15-20 |
| 3.033 | Tungsten | Cobalt | 20-25 |
| 3.034 | Tungsten | Nickel | 20-25 |
| 3.035 | Tungsten | Rhodium | 20-25 |
| 3.036 | Tungsten | Palladium | 20-25 |
| 3.037 | Tungsten | Platinum | 20-25 |
| 3.038 | Tungsten | Copper | 20-25 |
| 3.039 | Tungsten | Silver | 20-25 |
| 3.040 | Tungsten | Gold | 20-25 |
| 3.041 | Tungsten | Cobalt | 25-30 |
| 3.042 | Tungsten | Nickel | 25-30 |
| 3.043 | Tungsten | Rhodium | 25-30 |
| 3.044 | Tungsten | Palladium | 25-30 |
| 3.045 | Tungsten | Platinum | 25-30 |
| 3.046 | Tungsten | Copper | 25-30 |
| 3.047 | Tungsten | Silver | 25-30 |
| 3.048 | Tungsten | Gold | 25-30 |

Table 4: Table 4 consists of 48 alloys, the refractory metal being molybdenum instead of niobium and the non-refractory metal and the amount thereof in wt. % being as indicated in Table 1.

TABLE 4

| No. | Refractory metal | Non-refractory metal | Amount of non-refractory metal (wt. %) |
|---|---|---|---|
| 4.001 | Molybdenum | Cobalt | 2-5 |
| 4.002 | Molybdenum | Nickel | 2-5 |
| 4.003 | Molybdenum | Rhodium | 2-5 |
| 4.004 | Molybdenum | Palladium | 2-5 |
| 4.005 | Molybdenum | Platinum | 2-5 |
| 4.006 | Molybdenum | Copper | 2-5 |
| 4.007 | Molybdenum | Silver | 2-5 |
| 4.008 | Molybdenum | Gold | 2-5 |
| 4.009 | Molybdenum | Cobalt | 5-10 |
| 4.010 | Molybdenum | Nickel | 5-10 |
| 4.011 | Molybdenum | Rhodium | 5-10 |
| 4.012 | Molybdenum | Palladium | 5-10 |
| 4.013 | Molybdenum | Platinum | 5-10 |
| 4.014 | Molybdenum | Copper | 5-10 |
| 4.015 | Molybdenum | Silver | 5-10 |
| 4.016 | Molybdenum | Gold | 5-10 |
| 4.017 | Molybdenum | Cobalt | 10-15 |
| 4.018 | Molybdenum | Nickel | 10-15 |
| 4.019 | Molybdenum | Rhodium | 10-15 |
| 4.020 | Molybdenum | Palladium | 10-15 |
| 4.021 | Molybdenum | Platinum | 10-15 |
| 4.022 | Molybdenum | Copper | 10-15 |
| 4.023 | Molybdenum | Silver | 10-15 |
| 4.024 | Molybdenum | Gold | 10-15 |
| 4.025 | Molybdenum | Cobalt | 15-20 |
| 4.026 | Molybdenum | Nickel | 15-20 |
| 4.027 | Molybdenum | Rhodium | 15-20 |
| 4.028 | Molybdenum | Palladium | 15-20 |
| 4.029 | Molybdenum | Platinum | 15-20 |
| 4.030 | Molybdenum | Copper | 15-20 |
| 4.031 | Molybdenum | Silver | 15-20 |
| 4.032 | Molybdenum | Gold | 15-20 |
| 4.033 | Molybdenum | Cobalt | 20-25 |
| 4.034 | Molybdenum | Nickel | 20-25 |
| 4.035 | Molybdenum | Rhodium | 20-25 |
| 4.036 | Molybdenum | Palladium | 20-25 |
| 4.037 | Molybdenum | Platinum | 20-25 |

TABLE 4-continued

| No. | Refractory metal | Non-refractory metal | Amount of non-refractory metal (wt. %) |
|---|---|---|---|
| 4.038 | Molybdenum | Copper | 20-25 |
| 4.039 | Molybdenum | Silver | 20-25 |
| 4.040 | Molybdenum | Gold | 20-25 |
| 4.041 | Molybdenum | Cobalt | 25-30 |
| 4.042 | Molybdenum | Nickel | 25-30 |
| 4.043 | Molybdenum | Rhodium | 25-30 |
| 4.044 | Molybdenum | Palladium | 25-30 |
| 4.045 | Molybdenum | Platinum | 25-30 |
| 4.046 | Molybdenum | Copper | 25-30 |
| 4.047 | Molybdenum | Silver | 25-30 |
| 4.048 | Molybdenum | Gold | 25-30 |

Table 5: Table 5 consists of 48 alloys, the refractory metal being titanium instead of niobium and the non-refractory metal and the amount thereof in wt. % being as indicated in Table 1.

TABLE 5

| No. | Refractory metal | Non-refractory metal | Amount of non-refractory metal (wt. %) |
|---|---|---|---|
| 5.001 | Titanium | Cobalt | 2-5 |
| 5.002 | Titanium | Nickel | 2-5 |
| 5.003 | Titanium | Rhodium | 2-5 |
| 5.004 | Titanium | Palladium | 2-5 |
| 5.005 | Titanium | Platinum | 2-5 |
| 5.006 | Titanium | Copper | 2-5 |
| 5.007 | Titanium | Silver | 2-5 |
| 5.008 | Titanium | Gold | 2-5 |
| 5.009 | Titanium | Cobalt | 5-10 |
| 5.010 | Titanium | Nickel | 5-10 |
| 5.011 | Titanium | Rhodium | 5-10 |
| 5.012 | Titanium | Palladium | 5-10 |
| 5.013 | Titanium | Platinum | 5-10 |
| 5.014 | Titanium | Copper | 5-10 |
| 5.015 | Titanium | Silver | 5-10 |
| 5.016 | Titanium | Gold | 5-10 |
| 5.017 | Titanium | Cobalt | 10-15 |
| 5.018 | Titanium | Nickel | 10-15 |
| 5.019 | Titanium | Rhodium | 10-15 |
| 5.020 | Titanium | Palladium | 10-15 |
| 5.021 | Titanium | Platinum | 10-15 |
| 5.022 | Titanium | Copper | 10-15 |
| 5.023 | Titanium | Silver | 10-15 |
| 5.024 | Titanium | Gold | 10-15 |
| 5.025 | Titanium | Cobalt | 15-20 |
| 5.026 | Titanium | Nickel | 15-20 |
| 5.027 | Titanium | Rhodium | 15-20 |
| 5.028 | Titanium | Palladium | 15-20 |
| 5.029 | Titanium | Platinum | 15-20 |
| 5.030 | Titanium | Copper | 15-20 |
| 5.031 | Titanium | Silver | 15-20 |
| 5.032 | Titanium | Gold | 15-20 |
| 5.033 | Titanium | Cobalt | 20-25 |
| 5.034 | Titanium | Nickel | 20-25 |
| 5.035 | Titanium | Rhodium | 20-25 |
| 5.036 | Titanium | Palladium | 20-25 |
| 5.037 | Titanium | Platinum | 20-25 |
| 5.038 | Titanium | Copper | 20-25 |
| 5.039 | Titanium | Silver | 20-25 |
| 5.040 | Titanium | Gold | 20-25 |
| 5.041 | Titanium | Cobalt | 25-30 |
| 5.042 | Titanium | Nickel | 25-30 |
| 5.043 | Titanium | Rhodium | 25-30 |
| 5.044 | Titanium | Palladium | 25-30 |
| 5.045 | Titanium | Platinum | 25-30 |
| 5.046 | Titanium | Copper | 25-30 |
| 5.047 | Titanium | Silver | 25-30 |
| 5.048 | Titanium | Gold | 25-30 |

Table 6: Table 6 consists of 48 pseudo alloys, the refractory metal being tantalum instead of niobium and the non-refractory metal and the amount thereof in wt. % being as indicated in Table 1.

TABLE 6

| No. | Refractory metal | Non-refractory metal | Amount of non-refractory metal (wt. %) |
|---|---|---|---|
| 6.001 | Tantalum | Cobalt | 2-5 |
| 6.002 | Tantalum | Nickel | 2-5 |
| 6.003 | Tantalum | Rhodium | 2-5 |
| 6.004 | Tantalum | Palladium | 2-5 |
| 6.005 | Tantalum | Platinum | 2-5 |
| 6.006 | Tantalum | Copper | 2-5 |
| 6.007 | Tantalum | Silver | 2-5 |
| 6.008 | Tantalum | Gold | 2-5 |
| 6.009 | Tantalum | Cobalt | 5-10 |
| 6.010 | Tantalum | Nickel | 5-10 |
| 6.011 | Tantalum | Rhodium | 5-10 |
| 6.012 | Tantalum | Palladium | 5-10 |
| 6.013 | Tantalum | Platinum | 5-10 |
| 6.014 | Tantalum | Copper | 5-10 |
| 6.015 | Tantalum | Silver | 5-10 |
| 6.016 | Tantalum | Gold | 5-10 |
| 6.017 | Tantalum | Cobalt | 10-15 |
| 6.018 | Tantalum | Nickel | 10-15 |
| 6.019 | Tantalum | Rhodium | 10-15 |
| 6.020 | Tantalum | Palladium | 10-15 |
| 6.021 | Tantalum | Platinum | 10-15 |
| 6.022 | Tantalum | Copper | 10-15 |
| 6.023 | Tantalum | Silver | 10-15 |
| 6.024 | Tantalum | Gold | 10-15 |
| 6.025 | Tantalum | Cobalt | 15-20 |
| 6.026 | Tantalum | Nickel | 15-20 |
| 6.027 | Tantalum | Rhodium | 15-20 |
| 6.028 | Tantalum | Palladium | 15-20 |
| 6.029 | Tantalum | Platinum | 15-20 |
| 6.030 | Tantalum | Copper | 15-20 |
| 6.031 | Tantalum | Silver | 15-20 |
| 6.032 | Tantalum | Gold | 15-20 |
| 6.033 | Tantalum | Cobalt | 20-25 |
| 6.034 | Tantalum | Nickel | 20-25 |
| 6.035 | Tantalum | Rhodium | 20-25 |
| 6.036 | Tantalum | Palladium | 20-25 |
| 6.037 | Tantalum | Platinum | 20-25 |
| 6.038 | Tantalum | Copper | 20-25 |
| 6.039 | Tantalum | Silver | 20-25 |
| 6.040 | Tantalum | Gold | 20-25 |
| 6.041 | Tantalum | Cobalt | 25-30 |
| 6.042 | Tantalum | Nickel | 25-30 |
| 6.043 | Tantalum | Rhodium | 25-30 |
| 6.044 | Tantalum | Palladium | 25-30 |
| 6.045 | Tantalum | Platinum | 25-30 |
| 6.046 | Tantalum | Copper | 25-30 |
| 6.047 | Tantalum | Silver | 25-30 |
| 6.048 | Tantalum | Gold | 25-30 |

Table 7: Table 7 consists of 48 pseudo alloys, the refractory metal being tungsten instead of niobium and the non-refractory metal and the amount thereof in wt. % being as indicated in Table 1.

TABLE 7

| No. | Refractory metal | Non-refractory metal | Amount of non-refractory metal (wt. %) |
|---|---|---|---|
| 7.001 | Tungsten | Cobalt | 2-5 |
| 7.002 | Tungsten | Nickel | 2-5 |
| 7.003 | Tungsten | Rhodium | 2-5 |
| 7.004 | Tungsten | Palladium | 2-5 |
| 7.005 | Tungsten | Platinum | 2-5 |
| 7.006 | Tungsten | Copper | 2-5 |
| 7.007 | Tungsten | Silver | 2-5 |

TABLE 7-continued

| No. | Refractory metal | Non-refractory metal | Amount of non-refractory metal (wt. %) |
|---|---|---|---|
| 7.008 | Tungsten | Gold | 2-5 |
| 7.009 | Tungsten | Cobalt | 5-10 |
| 7.010 | Tungsten | Nickel | 5-10 |
| 7.011 | Tungsten | Rhodium | 5-10 |
| 7.012 | Tungsten | Palladium | 5-10 |
| 7.013 | Tungsten | Platinum | 5-10 |
| 7.014 | Tungsten | Copper | 5-10 |
| 7.015 | Tungsten | Silver | 5-10 |
| 7.016 | Tungsten | Gold | 5-10 |
| 7.017 | Tungsten | Cobalt | 10-15 |
| 7.018 | Tungsten | Nickel | 10-15 |
| 7.019 | Tungsten | Rhodium | 10-15 |
| 7.020 | Tungsten | Palladium | 10-15 |
| 7.021 | Tungsten | Platinum | 10-15 |
| 7.022 | Tungsten | Copper | 10-15 |
| 7.023 | Tungsten | Silver | 10-15 |
| 7.024 | Tungsten | Gold | 10-15 |
| 7.025 | Tungsten | Cobalt | 15-20 |
| 7.026 | Tungsten | Nickel | 15-20 |
| 7.027 | Tungsten | Rhodium | 15-20 |
| 7.028 | Tungsten | Palladium | 15-20 |
| 7.029 | Tungsten | Platinum | 15-20 |
| 7.030 | Tungsten | Copper | 15-20 |
| 7.031 | Tungsten | Silver | 15-20 |
| 7.032 | Tungsten | Gold | 15-20 |
| 7.033 | Tungsten | Cobalt | 20-25 |
| 7.034 | Tungsten | Nickel | 20-25 |
| 7.035 | Tungsten | Rhodium | 20-25 |
| 7.036 | Tungsten | Palladium | 20-25 |
| 7.037 | Tungsten | Platinum | 20-25 |
| 7.038 | Tungsten | Copper | 20-25 |
| 7.039 | Tungsten | Silver | 20-25 |
| 7.040 | Tungsten | Gold | 20-25 |
| 7.041 | Tungsten | Cobalt | 25-30 |
| 7.042 | Tungsten | Nickel | 25-30 |
| 7.043 | Tungsten | Rhodium | 25-30 |
| 7.044 | Tungsten | Palladium | 25-30 |
| 7.045 | Tungsten | Platinum | 25-30 |
| 7.046 | Tungsten | Copper | 25-30 |
| 7.047 | Tungsten | Silver | 25-30 |
| 7.048 | Tungsten | Gold | 25-30 |

Table 8: Table 8 consists of 48 pseudo alloys, the refractory metal being molybdenum instead of niobium and the non-refractory metal and the amount thereof in wt. % being as indicated in Table 1.

TABLE 8

| No. | Refractory metal | Non-refractory metal | Amount of non-refractory metal (wt. %) |
|---|---|---|---|
| 8.001 | Molybdenum | Cobalt | 2-5 |
| 8.002 | Molybdenum | Nickel | 2-5 |
| 8.003 | Molybdenum | Rhodium | 2-5 |
| 8.004 | Molybdenum | Palladium | 2-5 |
| 8.005 | Molybdenum | Platinum | 2-5 |
| 8.006 | Molybdenum | Copper | 2-5 |
| 8.007 | Molybdenum | Silver | 2-5 |
| 8.008 | Molybdenum | Gold | 2-5 |
| 8.009 | Molybdenum | Cobalt | 5-10 |
| 8.010 | Molybdenum | Nickel | 5-10 |
| 8.011 | Molybdenum | Rhodium | 5-10 |
| 8.012 | Molybdenum | Palladium | 5-10 |
| 8.013 | Molybdenum | Platinum | 5-10 |
| 8.014 | Molybdenum | Copper | 5-10 |
| 8.015 | Molybdenum | Silver | 5-10 |
| 8.016 | Molybdenum | Gold | 5-10 |
| 8.017 | Molybdenum | Cobalt | 10-15 |
| 8.018 | Molybdenum | Nickel | 10-15 |
| 8.019 | Molybdenum | Rhodium | 10-15 |
| 8.020 | Molybdenum | Palladium | 10-15 |

TABLE 8-continued

| No. | Refractory metal | Non-refractory metal | Amount of non-refractory metal (wt. %) |
|---|---|---|---|
| 8.021 | Molybdenum | Platinum | 10-15 |
| 8.022 | Molybdenum | Copper | 10-15 |
| 8.023 | Molybdenum | Silver | 10-15 |
| 8.024 | Molybdenum | Gold | 10-15 |
| 8.025 | Molybdenum | Cobalt | 15-20 |
| 8.026 | Molybdenum | Nickel | 15-20 |
| 8.027 | Molybdenum | Rhodium | 15-20 |
| 8.028 | Molybdenum | Palladium | 15-20 |
| 8.029 | Molybdenum | Platinum | 15-20 |
| 8.030 | Molybdenum | Copper | 15-20 |
| 8.031 | Molybdenum | Silver | 15-20 |
| 8.032 | Molybdenum | Gold | 15-20 |
| 8.033 | Molybdenum | Cobalt | 20-25 |
| 8.034 | Molybdenum | Nickel | 20-25 |
| 8.035 | Molybdenum | Rhodium | 20-25 |
| 8.036 | Molybdenum | Palladium | 20-25 |
| 8.037 | Molybdenum | Platinum | 20-25 |
| 8.038 | Molybdenum | Copper | 20-25 |
| 8.039 | Molybdenum | Silver | 20-25 |
| 8.040 | Molybdenum | Gold | 20-25 |
| 8.041 | Molybdenum | Cobalt | 25-30 |
| 8.042 | Molybdenum | Nickel | 25-30 |
| 8.043 | Molybdenum | Rhodium | 25-30 |
| 8.044 | Molybdenum | Palladium | 25-30 |
| 8.045 | Molybdenum | Platinum | 25-30 |
| 8.046 | Molybdenum | Copper | 25-30 |
| 8.047 | Molybdenum | Silver | 25-30 |
| 8.048 | Molybdenum | Gold | 25-30 |

Table 9: Table 9 consists of 48 pseudo alloys, the refractory metal being titanium instead of niobium and the non-refractory metal and the amount thereof in wt. % being as indicated in Table 1.

TABLE 9

| No. | Refractory metal | Non-refractory metal | Amount of non-refractory metal (wt.%) |
|---|---|---|---|
| 9.001 | Titanium | Cobalt | 2-5 |
| 9.002 | Titanium | Nickel | 2-5 |
| 9.003 | Titanium | Rhodium | 2-5 |
| 9.004 | Titanium | Palladium | 2-5 |
| 9.005 | Titanium | Platinum | 2-5 |
| 9.006 | Titanium | Copper | 2-5 |
| 9.007 | Titanium | Silver | 2-5 |
| 9.008 | Titanium | Gold | 2-5 |
| 9.009 | Titanium | Cobalt | 5-10 |
| 9.010 | Titanium | Nickel | 5-10 |
| 9.011 | Titanium | Rhodium | 5-10 |
| 9.012 | Titanium | Palladium | 5-10 |
| 9.013 | Titanium | Platinum | 5-10 |
| 9.014 | Titanium | Copper | 5-10 |
| 9.015 | Titanium | Silver | 5-10 |
| 9.016 | Titanium | Gold | 5-10 |
| 9.017 | Titanium | Cobalt | 10-15 |
| 9.018 | Titanium | Nickel | 10-15 |
| 9.019 | Titanium | Rhodium | 10-15 |
| 9.020 | Titanium | Palladium | 10-15 |
| 9.021 | Titanium | Platinum | 10-15 |
| 9.022 | Titanium | Copper | 10-15 |
| 9.023 | Titanium | Silver | 10-15 |
| 9.024 | Titanium | Gold | 10-15 |
| 9.025 | Titanium | Cobalt | 15-20 |
| 9.026 | Titanium | Nickel | 15-20 |
| 9.027 | Titanium | Rhodium | 15-20 |
| 9.028 | Titanium | Palladium | 15-20 |
| 9.029 | Titanium | Platinum | 15-20 |
| 9.030 | Titanium | Copper | 15-20 |
| 9.031 | Titanium | Silver | 15-20 |
| 9.032 | Titanium | Gold | 15-20 |
| 9.033 | Titanium | Cobalt | 20-25 |

TABLE 9-continued

| No. | Refractory metal | Non-refractory metal | Amount of non-refractory metal (wt.%) |
|---|---|---|---|
| 9.034 | Titanium | Nickel | 20-25 |
| 9.035 | Titanium | Rhodium | 20-25 |
| 9.036 | Titanium | Palladium | 20-25 |
| 9.037 | Titanium | Platinum | 20-25 |
| 9.038 | Titanium | Copper | 20-25 |
| 9.039 | Titanium | Silver | 20-25 |
| 9.040 | Titanium | Gold | 20-25 |
| 9.041 | Titanium | Cobalt | 25-30 |
| 9.042 | Titanium | Nickel | 25-30 |
| 9.043 | Titanium | Rhodium | 25-30 |
| 9.044 | Titanium | Palladium | 25-30 |
| 9.045 | Titanium | Platinum | 25-30 |
| 9.046 | Titanium | Copper | 25-30 |
| 9.047 | Titanium | Silver | 25-30 |
| 9.048 | Titanium | Gold | 25-30 |

Table 10: Table 10 consists of 48 powder mixtures, the refractory metal being tantalum instead of niobium and the non-refractory metal and the amount thereof in wt. % being as indicated in Table 1.

TABLE 10

| No. | Refractory metal | Non-refractory metal | Amount of non-refractory metal (wt.%) |
|---|---|---|---|
| 10.001 | Tantalum | Cobalt | 2-5 |
| 10.002 | Tantalum | Nickel | 2-5 |
| 10.003 | Tantalum | Rhodium | 2-5 |
| 10.004 | Tantalum | Palladium | 2-5 |
| 10.005 | Tantalum | Platinum | 2-5 |
| 10.006 | Tantalum | Copper | 2-5 |
| 10.007 | Tantalum | Silver | 2-5 |
| 10.008 | Tantalum | Gold | 2-5 |
| 10.009 | Tantalum | Cobalt | 5-10 |
| 10.010 | Tantalum | Nickel | 5-10 |
| 10.011 | Tantalum | Rhodium | 5-10 |
| 10.012 | Tantalum | Palladium | 5-10 |
| 10.013 | Tantalum | Platinum | 5-10 |
| 10.014 | Tantalum | Copper | 5-10 |
| 10.015 | Tantalum | Silver | 5-10 |
| 10.016 | Tantalum | Gold | 5-10 |
| 10.017 | Tantalum | Cobalt | 10-15 |
| 10.018 | Tantalum | Nickel | 10-15 |
| 10.019 | Tantalum | Rhodium | 10-15 |
| 10.020 | Tantalum | Palladium | 10-15 |
| 10.021 | Tantalum | Platinum | 10-15 |
| 10.022 | Tantalum | Copper | 10-15 |
| 10.023 | Tantalum | Silver | 10-15 |
| 10.024 | Tantalum | Gold | 10-15 |
| 10.025 | Tantalum | Cobalt | 15-20 |
| 10.026 | Tantalum | Nickel | 15-20 |
| 10.027 | Tantalum | Rhodium | 15-20 |
| 10.028 | Tantalum | Palladium | 15-20 |
| 10.029 | Tantalum | Platinum | 15-20 |
| 10.030 | Tantalum | Copper | 15-20 |
| 10.031 | Tantalum | Silver | 15-20 |
| 10.032 | Tantalum | Gold | 15-20 |
| 10.033 | Tantalum | Cobalt | 20-25 |
| 10.034 | Tantalum | Nickel | 20-25 |
| 10.035 | Tantalum | Rhodium | 20-25 |
| 10.036 | Tantalum | Palladium | 20-25 |
| 10.037 | Tantalum | Platinum | 20-25 |
| 10.038 | Tantalum | Copper | 20-25 |
| 10.039 | Tantalum | Silver | 20-25 |
| 10.040 | Tantalum | Gold | 20-25 |
| 10.041 | Tantalum | Cobalt | 25-30 |
| 10.042 | Tantalum | Nickel | 25-30 |
| 10.043 | Tantalum | Rhodium | 25-30 |
| 10.044 | Tantalum | Palladium | 25-30 |
| 10.045 | Tantalum | Platinum | 25-30 |
| 10.046 | Tantalum | Copper | 25-30 |

TABLE 10-continued

| No. | Refractory metal | Non-refractory metal | Amount of non-refractory metal (wt.%) |
|---|---|---|---|
| 10.047 | Tantalum | Silver | 25-30 |
| 10.048 | Tantalum | Gold | 25-30 |

Table 11: Table 11 consists of 48 powder mixtures, the refractory metal being tungsten instead of niobium and the non-refractory metal and the amount thereof in wt. % being as indicated in Table 1.

TABLE 11

| No. | Refractory metal | Non-refractory metal | Amount of non-refractory metal (wt.%) |
|---|---|---|---|
| 11.001 | Tungsten | Cobalt | 2-5 |
| 11.002 | Tungsten | Nickel | 2-5 |
| 11.003 | Tungsten | Rhodium | 2-5 |
| 11.004 | Tungsten | Palladium | 2-5 |
| 11.005 | Tungsten | Platinum | 2-5 |
| 11.006 | Tungsten | Copper | 2-5 |
| 11.007 | Tungsten | Silver | 2-5 |
| 11.008 | Tungsten | Gold | 2-5 |
| 11.009 | Tungsten | Cobalt | 5-10 |
| 11.010 | Tungsten | Nickel | 5-10 |
| 11.011 | Tungsten | Rhodium | 5-10 |
| 11.012 | Tungsten | Palladium | 5-10 |
| 11.013 | Tungsten | Platinum | 5-10 |
| 11.014 | Tungsten | Copper | 5-10 |
| 11.015 | Tungsten | Silver | 5-10 |
| 11.016 | Tungsten | Gold | 5-10 |
| 11.017 | Tungsten | Cobalt | 10-15 |
| 11.018 | Tungsten | Nickel | 10-15 |
| 11.019 | Tungsten | Rhodium | 10-15 |
| 11.020 | Tungsten | Palladium | 10-15 |
| 11.021 | Tungsten | Platinum | 10-15 |
| 11.022 | Tungsten | Copper | 10-15 |
| 11.023 | Tungsten | Silver | 10-15 |
| 11.024 | Tungsten | Gold | 10-15 |
| 11.025 | Tungsten | Cobalt | 15-20 |
| 11.026 | Tungsten | Nickel | 15-20 |
| 11.027 | Tungsten | Rhodium | 15-20 |
| 11.028 | Tungsten | Palladium | 15-20 |
| 11.029 | Tungsten | Platinum | 15-20 |
| 11.030 | Tungsten | Copper | 15-20 |
| 11.031 | Tungsten | Silver | 15-20 |
| 11.032 | Tungsten | Gold | 15-20 |
| 11.033 | Tungsten | Cobalt | 20-25 |
| 11.034 | Tungsten | Nickel | 20-25 |
| 11.035 | Tungsten | Rhodium | 20-25 |
| 11.036 | Tungsten | Palladium | 20-25 |
| 11.037 | Tungsten | Platinum | 20-25 |
| 11.038 | Tungsten | Copper | 20-25 |
| 11.039 | Tungsten | Silver | 20-25 |
| 11.040 | Tungsten | Gold | 20-25 |
| 11.041 | Tungsten | Cobalt | 25-30 |
| 11.042 | Tungsten | Nickel | 25-30 |
| 11.043 | Tungsten | Rhodium | 25-30 |
| 11.044 | Tungsten | Palladium | 25-30 |
| 11.045 | Tungsten | Platinum | 25-30 |
| 11.046 | Tungsten | Copper | 25-30 |
| 11.047 | Tungsten | Silver | 25-30 |
| 11.048 | Tungsten | Gold | 25-30 |

Table 12: Table 12 consists of 48 powder mixtures, the refractory metal being molybdenum instead of niobium and the non-refractory metal and the amount thereof in wt. % being as indicated in Table 1.

TABLE 12

| No. | Refractory metal | Non-refractory metal | Amount of non-refractory metal (wt.%) |
|---|---|---|---|
| 12.001 | Molybdenum | Cobalt | 2-5 |
| 12.002 | Molybdenum | Nickel | 2-5 |
| 12.003 | Molybdenum | Rhodium | 2-5 |
| 12.004 | Molybdenum | Palladium | 2-5 |
| 12.005 | Molybdenum | Platinum | 2-5 |
| 12.006 | Molybdenum | Copper | 2-5 |
| 12.007 | Molybdenum | Silver | 2-5 |
| 12.008 | Molybdenum | Gold | 2-5 |
| 12.009 | Molybdenum | Cobalt | 5-10 |
| 12.010 | Molybdenum | Nickel | 5-10 |
| 12.011 | Molybdenum | Rhodium | 5-10 |
| 12.012 | Molybdenum | Palladium | 5-10 |
| 12.013 | Molybdenum | Platinum | 5-10 |
| 12.014 | Molybdenum | Copper | 5-10 |
| 12.015 | Molybdenum | Silver | 5-10 |
| 12.016 | Molybdenum | Gold | 5-10 |
| 12.017 | Molybdenum | Cobalt | 10-15 |
| 12.018 | Molybdenum | Nickel | 10-15 |
| 12.019 | Molybdenum | Rhodium | 10-15 |
| 12.020 | Molybdenum | Palladium | 10-15 |
| 12.021 | Molybdenum | Platinum | 10-15 |
| 12.022 | Molybdenum | Copper | 10-15 |
| 12.023 | Molybdenum | Silver | 10-15 |
| 12.024 | Molybdenum | Gold | 10-15 |
| 12.025 | Molybdenum | Cobalt | 15-20 |
| 12.026 | Molybdenum | Nickel | 15-20 |
| 12.027 | Molybdenum | Rhodium | 15-20 |
| 12.028 | Molybdenum | Palladium | 15-20 |
| 12.029 | Molybdenum | Platinum | 15-20 |
| 12.030 | Molybdenum | Copper | 15-20 |
| 12.031 | Molybdenum | Silver | 15-20 |
| 12.032 | Molybdenum | Gold | 15-20 |
| 12.033 | Molybdenum | Cobalt | 20-25 |
| 12.034 | Molybdenum | Nickel | 20-25 |
| 12.035 | Molybdenum | Rhodium | 20-25 |
| 12.036 | Molybdenum | Palladium | 20-25 |
| 12.037 | Molybdenum | Platinum | 20-25 |
| 12.038 | Molybdenum | Copper | 20-25 |
| 12.039 | Molybdenum | Silver | 20-25 |
| 12.040 | Molybdenum | Gold | 20-25 |
| 12.041 | Molybdenum | Cobalt | 25-30 |
| 12.042 | Molybdenum | Nickel | 25-30 |
| 12.043 | Molybdenum | Rhodium | 25-30 |
| 12.044 | Molybdenum | Palladium | 25-30 |
| 12.045 | Molybdenum | Platinum | 25-30 |
| 12.046 | Molybdenum | Copper | 25-30 |
| 12.047 | Molybdenum | Silver | 25-30 |
| 12.048 | Molybdenum | Gold | 25-30 |

Table 13: Table 13 consists of 48 powder mixtures, the refractory metal being titanium instead of niobium and the non-refractory metal and the amount thereof in wt. % being as indicated in Table 1.

TABLE 13

| No. | Refractory metal | Non-refractory metal | Amount of non-refractory metal (wt.%) |
|---|---|---|---|
| 13.001 | Titanium | Cobalt | 2-5 |
| 13.002 | Titanium | Nickel | 2-5 |
| 13.003 | Titanium | Rhodium | 2-5 |
| 13.004 | Titanium | Palladium | 2-5 |
| 13.005 | Titanium | Platinum | 2-5 |
| 13.006 | Titanium | Copper | 2-5 |
| 13.007 | Titanium | Silver | 2-5 |
| 13.008 | Titanium | Gold | 2-5 |
| 13.009 | Titanium | Cobalt | 5-10 |
| 13.010 | Titanium | Nickel | 5-10 |
| 13.011 | Titanium | Rhodium | 5-10 |
| 13.012 | Titanium | Palladium | 5-10 |
| 13.013 | Titanium | Platinum | 5-10 |

TABLE 13-continued

| No. | Refractory metal | Non-refractory metal | Amount of non-refractory metal (wt.%) |
|---|---|---|---|
| 13.014 | Titanium | Copper | 5-10 |
| 13.015 | Titanium | Silver | 5-10 |
| 13.016 | Titanium | Gold | 5-10 |
| 13.017 | Titanium | Cobalt | 10-15 |
| 13.018 | Titanium | Nickel | 10-15 |
| 13.019 | Titanium | Rhodium | 10-15 |
| 13.020 | Titanium | Palladium | 10-15 |
| 13.021 | Titanium | Platinum | 10-15 |
| 13.022 | Titanium | Copper | 10-15 |
| 13.023 | Titanium | Silver | 10-15 |
| 13.024 | Titanium | Gold | 10-15 |
| 13.025 | Titanium | Cobalt | 15-20 |
| 13.026 | Titanium | Nickel | 15-20 |
| 13.027 | Titanium | Rhodium | 15-20 |
| 13.028 | Titanium | Palladium | 15-20 |
| 13.029 | Titanium | Platinum | 15-20 |
| 13.030 | Titanium | Copper | 15-20 |
| 13.031 | Titanium | Silver | 15-20 |
| 13.032 | Titanium | Gold | 15-20 |
| 13.033 | Titanium | Cobalt | 20-25 |
| 13.034 | Titanium | Nickel | 20-25 |
| 13.035 | Titanium | Rhodium | 20-25 |
| 13.036 | Titanium | Palladium | 20-25 |
| 13.037 | Titanium | Platinum | 20-25 |
| 13.038 | Titanium | Copper | 20-25 |
| 13.039 | Titanium | Silver | 20-25 |
| 13.040 | Titanium | Gold | 20-25 |
| 13.041 | Titanium | Cobalt | 25-30 |
| 13.042 | Titanium | Nickel | 25-30 |
| 13.043 | Titanium | Rhodium | 25-30 |
| 13.044 | Titanium | Palladium | 25-30 |
| 13.045 | Titanium | Platinum | 25-30 |
| 13.046 | Titanium | Copper | 25-30 |
| 13.047 | Titanium | Silver | 25-30 |
| 13.048 | Titanium | Gold | 25-30 |

Table 14: Table 14 consists of 48 pseudo alloys, the refractory metal being niobium and the non-refractory metal and the amount thereof in wt. % being as indicated in Table 1.

TABLE 14

| No. | Refractory metal | Non-refractory metal | Amount of non-refractory metal (wt.%) |
|---|---|---|---|
| 14.001 | Niobium | Cobalt | 2-5 |
| 14.002 | Niobium | Nickel | 2-5 |
| 14.003 | Niobium | Rhodium | 2-5 |
| 14.004 | Niobium | Palladium | 2-5 |
| 14.005 | Niobium | Platinum | 2-5 |
| 14.006 | Niobium | Copper | 2-5 |
| 14.007 | Niobium | Silver | 2-5 |
| 14.008 | Niobium | Gold | 2-5 |
| 14.009 | Niobium | Cobalt | 5-10 |
| 14.010 | Niobium | Nickel | 5-10 |
| 14.011 | Niobium | Rhodium | 5-10 |
| 14.012 | Niobium | Palladium | 5-10 |
| 14.013 | Niobium | Platinum | 5-10 |
| 14.014 | Niobium | Copper | 5-10 |
| 14.015 | Niobium | Silver | 5-10 |
| 14.016 | Niobium | Gold | 5-10 |
| 14.017 | Niobium | Cobalt | 10-15 |
| 14.018 | Niobium | Nickel | 10-15 |
| 14.019 | Niobium | Rhodium | 10-15 |
| 14.020 | Niobium | Palladium | 10-15 |
| 14.021 | Niobium | Platinum | 10-15 |
| 14.022 | Niobium | Copper | 10-15 |
| 14.023 | Niobium | Silver | 10-15 |
| 14.024 | Niobium | Gold | 10-15 |
| 14.025 | Niobium | Cobalt | 15-20 |
| 14.026 | Niobium | Nickel | 15-20 |
| 14.027 | Niobium | Rhodium | 15-20 |
| 14.028 | Niobium | Palladium | 15-20 |

TABLE 14-continued

| No. | Refractory metal | Non-refractory metal | Amount of non-refractory metal (wt.%) |
|---|---|---|---|
| 14.029 | Niobium | Platinum | 15-20 |
| 14.030 | Niobium | Copper | 15-20 |
| 14.031 | Niobium | Silver | 15-20 |
| 14.032 | Niobium | Gold | 15-20 |
| 14.033 | Niobium | Cobalt | 20-25 |
| 14.034 | Niobium | Nickel | 20-25 |
| 14.035 | Niobium | Rhodium | 20-25 |
| 14.036 | Niobium | Palladium | 20-25 |
| 14.037 | Niobium | Platinum | 20-25 |
| 14.038 | Niobium | Copper | 20-25 |
| 14.039 | Niobium | Silver | 20-25 |
| 14.040 | Niobium | Gold | 20-25 |
| 14.041 | Niobium | Cobalt | 25-30 |
| 14.042 | Niobium | Nickel | 25-30 |
| 14.043 | Niobium | Rhodium | 25-30 |
| 14.044 | Niobium | Palladium | 25-30 |
| 14.045 | Niobium | Platinum | 25-30 |
| 14.046 | Niobium | Copper | 25-30 |
| 14.047 | Niobium | Silver | 25-30 |
| 14.048 | Niobium | Gold | 25-30 |

Table 15: Table 15 consists of 48 powder mixtures, the refractory metal being niobium and non-refractory metal and the amount thereof in wt. % being as indicated in Table 1.

TABLE 15

| No. | Refractory metal | Non-refractory metal | Amount of non-refractory metal (wt.%) |
|---|---|---|---|
| 15.001 | Niobium | Cobalt | 2-5 |
| 15.002 | Niobium | Nickel | 2-5 |
| 15.003 | Niobium | Rhodium | 2-5 |
| 15.004 | Niobium | Palladium | 2-5 |
| 15.005 | Niobium | Platinum | 2-5 |
| 15.006 | Niobium | Copper | 2-5 |
| 15.007 | Niobium | Silver | 2-5 |
| 15.008 | Niobium | Gold | 2-5 |
| 15.009 | Niobium | Cobalt | 5-10 |
| 15.010 | Niobium | Nickel | 5-10 |
| 15.011 | Niobium | Rhodium | 5-10 |
| 15.012 | Niobium | Palladium | 5-10 |
| 15.013 | Niobium | Platinum | 5-10 |
| 15.014 | Niobium | Copper | 5-10 |
| 15.015 | Niobium | Silver | 5-10 |
| 15.016 | Niobium | Gold | 5-10 |
| 15.017 | Niobium | Cobalt | 10-15 |
| 15.018 | Niobium | Nickel | 10-15 |
| 15.019 | Niobium | Rhodium | 10-15 |
| 15.020 | Niobium | Palladium | 10-15 |
| 15.021 | Niobium | Platinum | 10-15 |
| 15.022 | Niobium | Copper | 10-15 |
| 15.023 | Niobium | Silver | 10-15 |
| 15.024 | Niobium | Gold | 10-15 |
| 15.025 | Niobium | Cobalt | 15-20 |
| 15.026 | Niobium | Nickel | 15-20 |
| 15.027 | Niobium | Rhodium | 15-20 |
| 15.028 | Niobium | Palladium | 15-20 |
| 15.029 | Niobium | Platinum | 15-20 |
| 15.030 | Niobium | Copper | 15-20 |
| 15.031 | Niobium | Silver | 15-20 |
| 15.032 | Niobium | Gold | 15-20 |
| 15.033 | Niobium | Cobalt | 20-25 |
| 15.034 | Niobium | Nickel | 20-25 |
| 15.035 | Niobium | Rhodium | 20-25 |
| 15.036 | Niobium | Palladium | 20-25 |
| 15.037 | Niobium | Platinum | 20-25 |
| 15.038 | Niobium | Copper | 20-25 |
| 15.039 | Niobium | Silver | 20-25 |
| 15.040 | Niobium | Gold | 20-25 |
| 15.041 | Niobium | Cobalt | 25-30 |
| 15.042 | Niobium | Nickel | 25-30 |
| 15.043 | Niobium | Rhodium | 25-30 |

TABLE 15-continued

| No. | Refractory metal | Non-refractory metal | Amount of non-refractory metal (wt.%) |
|---|---|---|---|
| 15.044 | Niobium | Palladium | 25-30 |
| 15.045 | Niobium | Platinum | 25-30 |
| 15.046 | Niobium | Copper | 25-30 |
| 15.047 | Niobium | Silver | 25-30 |
| 15.048 | Niobium | Gold | 25-30 |

Table 17: Table 17 consists of 20 alloys, pseudo alloys and powder mixtures according to Table 16, component 1 being present in an amount of 2-5 wt. %, component 2 being present in an amount ad 100 wt. % and the individual partners in the mixture being as listed in Table 16.

TABLE 17

| | Component 1 | Amount of component 1 | Component 2 | Amount of component 2 |
|---|---|---|---|---|
| 17.001 | Nb | 2-5 wt. % | Ta | ad 100 wt. % |
| 17.002 | Nb | 2-5 wt. % | W | ad 100 wt. % |
| 17.003 | Nb | 2-5 wt. % | Mo | ad 100 wt. % |
| 17.004 | Nb | 2-5 wt. % | Ti | ad 100 wt. % |
| 17.005 | Ta | 2-5 wt. % | Nb | ad 100 wt. % |
| 17.006 | Ta | 2-5 wt. % | W | ad 100 wt. % |
| 17.007 | Ta | 2-5 wt. % | Mo | ad 100 wt. % |
| 17.008 | Ta | 2-5 wt. % | Ti | ad 100 wt. % |
| 17.009 | W | 2-5 wt. % | Ta | ad 100 wt. % |
| 17.010 | W | 2-5 wt. % | Nb | ad 100 wt. % |
| 17.011 | W | 2-5 wt. % | Mo | ad 100 wt. % |
| 17.012 | W | 2-5 wt. % | Ti | ad 100 wt. % |
| 17.013 | Mo | 2-5 wt. % | Ta | ad 100 wt. % |
| 17.014 | Mo | 2-5 wt. % | Nb | ad 100 wt. % |
| 17.015 | Mo | 2-5 wt. % | W | ad 100 wt. % |
| 17.016 | Mo | 2-5 wt. % | Ti | ad 100 wt. % |
| 17.017 | Ti | 2-5 wt. % | Ta | ad 100 wt. % |
| 17.018 | Ti | 2-5 wt. % | Nb | ad 100 wt. % |
| 17.019 | Ti | 2-5 wt. % | W | ad 100 wt. % |
| 17.020 | Ti | 2-5 wt. % | Mo | ad 100 wt. % |

Table 18: Table 18 consists of 20 alloys, pseudo alloys and powder mixtures according to Table 16, component 1 being present in an amount of 5-10 wt. %, component 2 being present in an amount ad 100 wt. % and the individual partners in the mixture being listed in Table 16.

TABLE 18

| | Component 1 | Amount of component 1 | Component 2 | Amount of component 2 |
|---|---|---|---|---|
| 18.001 | Nb | 5-10 wt. % | Ta | ad 100 wt. % |
| 18.002 | Nb | 5-10 wt. % | W | ad 100 wt. % |
| 18.003 | Nb | 5-10 wt. % | Mo | ad 100 wt. % |
| 18.004 | Nb | 5-10 wt. % | Ti | ad 100 wt. % |
| 18.005 | Ta | 5-10 wt. % | Nb | ad 100 wt. % |
| 18.006 | Ta | 5-10 wt. % | W | ad 100 wt. % |
| 18.007 | Ta | 5-10 wt. % | Mo | ad 100 wt. % |
| 18.008 | Ta | 5-10 wt. % | Ti | ad 100 wt. % |
| 18.009 | W | 5-10 wt. % | Ta | ad 100 wt. % |
| 18.010 | W | 5-10 wt. % | Nb | ad 100 wt. % |
| 18.011 | W | 5-10 wt. % | Mo | ad 100 wt. % |
| 18.012 | W | 5-10 wt. % | Ti | ad 100 wt. % |
| 18.013 | Mo | 5-10 wt. % | Ta | ad 100 wt. % |
| 18.014 | Mo | 5-10 wt. % | Nb | ad 100 wt. % |
| 18.015 | Mo | 5-10 wt. % | W | ad 100 wt. % |
| 18.016 | Mo | 5-10 wt. % | Ti | ad 100 wt. % |
| 18.017 | Ti | 5-10 wt. % | Ta | ad 100 wt. % |
| 18.018 | Ti | 5-10 wt. % | Nb | ad 100 wt. % |
| 18.019 | Ti | 5-10 wt. % | W | ad 100 wt. % |
| 18.020 | Ti | 5-10 wt. % | Mo | ad 100 wt. % |

Table 19: Table 19 consists of 20 alloys, pseudo alloys and powder mixtures according to Table 16, component 1 being present in an amount of 10-15 wt. %, component 2 being present in an amount ad 100 wt. % and the individual partners in the mixture being as listed in Table 16.

TABLE 19

| | Component 1 | Amount of component 1 | Component 2 | Amount of component 2 |
|---|---|---|---|---|
| 19.001 | Nb | 10-15 wt. % | Ta | ad 100 wt. % |
| 19.002 | Nb | 10-15 wt. % | W | ad 100 wt. % |
| 19.003 | Nb | 10-15 wt. % | Mo | ad 100 wt. % |
| 19.004 | Nb | 10-15 wt. % | Ti | ad 100 wt. % |
| 19.005 | Ta | 10-15 wt. % | Nb | ad 100 wt. % |
| 19.006 | Ta | 10-15 wt. % | W | ad 100 wt. % |
| 19.007 | Ta | 10-15 wt. % | Mo | ad 100 wt. % |
| 19.008 | Ta | 10-15 wt. % | Ti | ad 100 wt. % |
| 19.009 | W | 10-15 wt. % | Ta | ad 100 wt. % |
| 19.010 | W | 10-15 wt. % | Nb | ad 100 wt. % |
| 19.011 | W | 10-15 wt. % | Mo | ad 100 wt. % |
| 19.012 | W | 10-15 wt. % | Ti | ad 100 wt. % |
| 19.013 | Mo | 10-15 wt. % | Ta | ad 100 wt. % |
| 19.014 | Mo | 10-15 wt. % | Nb | ad 100 wt. % |
| 19.015 | Mo | 10-15 wt. % | W | ad 100 wt. % |
| 19.016 | Mo | 10-15 wt. % | Ti | ad 100 wt. % |
| 19.017 | Ti | 10-15 wt. % | Ta | ad 100 wt. % |
| 19.018 | Ti | 10-15 wt. % | Nb | ad 100 wt. % |
| 19.019 | Ti | 10-15 wt. % | W | ad 100 wt. % |
| 19.020 | Ti | 10-15 wt. % | Mo | ad 100 wt. % |

Table 20: Table 20 consists of 20 alloys, pseudo alloys and powder mixtures according to Table 16, component 1 being present in an amount of 15-20 wt. %, component 2 being present in an amount ad 100 wt. % and the individual partners in the mixture being as listed in Table 16.

TABLE 20

| | Component 1 | Amount of component 1 | Component 2 | Amount of component 2 |
|---|---|---|---|---|
| 20.001 | Nb | 15-20 wt. % | Ta | ad 100 wt. % |
| 20.002 | Nb | 15-20 wt. % | W | ad 100 wt. % |
| 20.003 | Nb | 15-20 wt. % | Mo | ad 100 wt. % |
| 20.004 | Nb | 15-20 wt. % | Ti | ad 100 wt. % |
| 20.005 | Ta | 15-20 wt. % | Nb | ad 100 wt. % |
| 20.006 | Ta | 15-20 wt. % | W | ad 100 wt. % |
| 20.007 | Ta | 15-20 wt. % | Mo | ad 100 wt. % |
| 20.008 | Ta | 15-20 wt. % | Ti | ad 100 wt. % |
| 20.009 | W | 15-20 wt. % | Ta | ad 100 wt. % |
| 20.010 | W | 15-20 wt. % | Nb | ad 100 wt. % |
| 20.011 | W | 15-20 wt. % | Mo | ad 100 wt. % |
| 20.012 | W | 15-20 wt. % | Ti | ad 100 wt. % |
| 20.013 | Mo | 15-20 wt. % | Ta | ad 100 wt. % |
| 20.014 | Mo | 15-20 wt. % | Nb | ad 100 wt. % |
| 20.015 | Mo | 15-20 wt. % | W | ad 100 wt. % |
| 20.016 | Mo | 15-20 wt. % | Ti | ad 100 wt. % |
| 20.017 | Ti | 15-20 wt. % | Ta | ad 100 wt. % |
| 20.018 | Ti | 15-20 wt. % | Nb | ad 100 wt. % |
| 20.019 | Ti | 15-20 wt. % | W | ad 100 wt. % |
| 20.020 | Ti | 15-20 wt. % | Mo | ad 100 wt. % |

Table 21: Table 21 consists of 20 alloys, pseudo alloys and powder mixtures according to Table 16, component 1 being present in an amount of 20-25 wt. %, component 2 being present in an amount ad 100 wt. % and the individual partners in the mixture being as listed in Table 16.

TABLE 21

| | Component 1 | Amount of component 1 | Component 2 | Amount of component 2 |
|---|---|---|---|---|
| 21.001 | Nb | 20-25 wt. % | Ta | ad 100 wt. % |
| 21.002 | Nb | 20-25 wt. % | W | ad 100 wt. % |
| 21.003 | Nb | 20-25 wt. % | Mo | ad 100 wt. % |
| 21.004 | Nb | 20-25 wt. % | Ti | ad 100 wt. % |
| 21.005 | Ta | 20-25 wt. % | Nb | ad 100 wt. % |
| 21.006 | Ta | 20-25 wt. % | W | ad 100 wt. % |
| 21.007 | Ta | 20-25 wt. % | Mo | ad 100 wt. % |
| 21.008 | Ta | 20-25 wt. % | Ti | ad 100 wt. % |
| 21.009 | W | 20-25 wt. % | Ta | ad 100 wt. % |
| 21.010 | W | 20-25 wt. % | Nb | ad 100 wt. % |
| 21.011 | W | 20-25 wt. % | Mo | ad 100 wt. % |
| 21.012 | W | 20-25 wt. % | Ti | ad 100 wt. % |
| 21.013 | Mo | 20-25 wt. % | Ta | ad 100 wt. % |
| 21.014 | Mo | 20-25 wt. % | Nb | ad 100 wt. % |
| 21.015 | Mo | 20-25 wt. % | W | ad 100 wt. % |
| 21.016 | Mo | 20-25 wt. % | Ti | ad 100 wt. % |
| 21.017 | Ti | 20-25 wt. % | Ta | ad 100 wt. % |
| 21.018 | Ti | 20-25 wt. % | Nb | ad 100 wt. % |
| 21.019 | Ti | 20-25 wt. % | W | ad 100 wt. % |
| 21.020 | Ti | 20-25 wt. % | Mo | ad 100 wt. % |

Table 22: Table 22 consists of 20 alloys, pseudo alloys and powder mixtures according to Table 16, component 1 being present in an amount of 25-30 wt. %, component 2 being present in an amount ad 100 wt. % and the individual partners in the mixture being as listed in Table 16.

TABLE 22

| | Component 1 | Amount of component 1 | Component 2 | Amount of component 2 |
|---|---|---|---|---|
| 22.001 | Nb | 25-30 wt. % | Ta | ad 100 wt. % |
| 22.002 | Nb | 25-30 wt. % | W | ad 100 wt. % |
| 22.003 | Nb | 25-30 wt. % | Mo | ad 100 wt. % |
| 22.004 | Nb | 25-30 wt. % | Ti | ad 100 wt. % |
| 22.005 | Ta | 25-30 wt. % | Nb | ad 100 wt. % |
| 22.006 | Ta | 25-30 wt. % | W | ad 100 wt. % |
| 22.007 | Ta | 25-30 wt. % | Mo | ad 100 wt. % |
| 22.008 | Ta | 25-30 wt. % | Ti | ad 100 wt. % |
| 22.009 | W | 25-30 wt. % | Ta | ad 100 wt. % |
| 22.010 | W | 25-30 wt. % | Nb | ad 100 wt. % |
| 22.011 | W | 25-30 wt. % | Mo | ad 100 wt. % |
| 22.012 | W | 25-30 wt. % | Ti | ad 100 wt. % |
| 22.013 | Mo | 25-30 wt. % | Ta | ad 100 wt. % |
| 22.014 | Mo | 25-30 wt. % | Nb | ad 100 wt. % |
| 22.015 | Mo | 25-30 wt. % | W | ad 100 wt. % |
| 22.016 | Mo | 25-30 wt. % | Ti | ad 100 wt. % |
| 22.017 | Ti | 25-30 wt. % | Ta | ad 100 wt. % |
| 22.018 | Ti | 25-30 wt. % | Nb | ad 100 wt. % |
| 22.019 | Ti | 25-30 wt. % | W | ad 100 wt. % |
| 22.020 | Ti | 25-30 wt. % | Mo | ad 100 wt. % |

Table 23: Table 23 consists of 20 alloys, pseudo alloys and powder mixtures according to Table 16, component 1 being present in an amount of 30-35 wt. %, component 2 being present in an amount ad 100 wt. % and the individual partners in the mixture being as listed in Table 16.

TABLE 23

| | Component 1 | Amount of component 1 | Component 2 | Amount of component 2 |
|---|---|---|---|---|
| 23.001 | Nb | 30-35 wt. % | Ta | ad 100 wt. % |
| 23.002 | Nb | 30-35 wt. % | W | ad 100 wt. % |
| 23.003 | Nb | 30-35 wt. % | Mo | ad 100 wt. % |
| 23.004 | Nb | 30-35 wt. % | Ti | ad 100 wt. % |
| 23.005 | Ta | 30-35 wt. % | Nb | ad 100 wt. % |
| 23.006 | Ta | 30-35 wt. % | W | ad 100 wt. % |
| 23.007 | Ta | 30-35 wt. % | Mo | ad 100 wt. % |
| 23.008 | Ta | 30-35 wt. % | Ti | ad 100 wt. % |

TABLE 23-continued

| | Component 1 | Amount of component 1 | Component 2 | Amount of component 2 |
|---|---|---|---|---|
| 23.009 | W | 30-35 wt. % | Ta | ad 100 wt. % |
| 23.010 | W | 30-35 wt. % | Nb | ad 100 wt. % |
| 23.011 | W | 30-35 wt. % | Mo | ad 100 wt. % |
| 23.012 | W | 30-35 wt. % | Ti | ad 100 wt. % |
| 23.013 | Mo | 30-35 wt. % | Ta | ad 100 wt. % |
| 23.014 | Mo | 30-35 wt. % | Nb | ad 100 wt. % |
| 23.015 | Mo | 30-35 wt. % | W | ad 100 wt. % |
| 23.016 | Mo | 30-35 wt. % | Ti | ad 100 wt. % |
| 23.017 | Ti | 30-35 wt. % | Ta | ad 100 wt. % |
| 23.018 | Ti | 30-35 wt. % | Nb | ad 100 wt. % |
| 23.019 | Ti | 30-35 wt. % | W | ad 100 wt. % |
| 23.020 | Ti | 30-35 wt. % | Mo | ad 100 wt .% |

Table 24: Table 24 consists of 20 alloys, pseudo alloys and powder mixtures according to Table 16, component 1 being present in an amount of 35-40 wt. %, component 2 being present in an amount ad 100 wt. % and the individual partners in the mixture being as listed in Table 16.

TABLE 24

| | Component 1 | Amount of component 1 | Component 2 | Amount of component 2 |
|---|---|---|---|---|
| 24.001 | Nb | 35-40 wt. % | Ta | ad 100 wt. % |
| 24.002 | Nb | 35-40 wt. % | W | ad 100 wt. % |
| 24.003 | Nb | 35-40 wt. % | Mo | ad 100 wt. % |
| 24.004 | Nb | 35-40 wt. % | Ti | ad 100 wt. % |
| 24.005 | Ta | 35-40 wt. % | Nb | ad 100 wt. % |
| 24.006 | Ta | 35-40 wt. % | W | ad 100 wt. % |
| 24.007 | Ta | 35-40 wt. % | Mo | ad 100 wt. % |
| 24.008 | Ta | 35-40 wt. % | Ti | ad 100 wt. % |
| 24.009 | W | 35-40 wt. % | Ta | ad 100 wt. % |
| 24.010 | W | 35-40 wt. % | Nb | ad 100 wt. % |
| 24.011 | W | 35-40 wt. % | Mo | ad 100 wt. % |
| 24.012 | W | 35-40 wt. % | Ti | ad 100 wt. % |
| 24.013 | Mo | 35-40 wt. % | Ta | ad 100 wt. % |
| 24.014 | Mo | 35-40 wt. % | Nb | ad 100 wt. % |
| 24.015 | Mo | 35-40 wt. % | W | ad 100 wt. % |
| 24.016 | Mo | 35-40 wt. % | Ti | ad 100 wt. % |
| 24.017 | Ti | 35-40 wt. % | Ta | ad 100 wt. % |
| 24.018 | Ti | 35-40 wt. % | Nb | ad 100 wt. % |
| 24.019 | Ti | 35-40 wt. % | W | ad 100 wt. % |
| 24.020 | Ti | 35-40 wt. % | Mo | ad 100 wt. % |

Table 25: Table 25 consists of 20 alloys, pseudo alloys and powder mixtures according to Table 16, component 1 being present in an amount of 40-45 wt. %, component 2 being present in an amount ad 100 wt. % and the individual partners in the mixture being as listed in Table 16.

TABLE 25

| | Component 1 | Amount of component 1 | Component 2 | Amount of component 2 |
|---|---|---|---|---|
| 25.001 | Nb | 40-45 wt. % | Ta | ad 100 wt. % |
| 25.002 | Nb | 40-45 wt. % | W | ad 100 wt. % |
| 25.003 | Nb | 40-45 wt. % | Mo | ad 100 wt. % |
| 25.004 | Nb | 40-45 wt. % | Ti | ad 100 wt. % |
| 25.005 | Ta | 40-45 wt. % | Nb | ad 100 wt. % |
| 25.006 | Ta | 40-45 wt. % | W | ad 100 wt. % |
| 25.007 | Ta | 40-45 wt. % | Mo | ad 100 wt. % |
| 25.008 | Ta | 40-45 wt. % | Ti | ad 100 wt. % |
| 25.009 | W | 40-45 wt. % | Ta | ad 100 wt. % |
| 25.010 | W | 40-45 wt. % | Nb | ad 100 wt. % |
| 25.011 | W | 40-45 wt. % | Mo | ad 100 wt. % |
| 25.012 | W | 40-45 wt. % | Ti | ad 100 wt. % |
| 25.013 | Mo | 40-45 wt. % | Ta | ad 100 wt. % |
| 25.014 | Mo | 40-45 wt. % | Nb | ad 100 wt. % |
| 25.015 | Mo | 40-45 wt. % | W | ad 100 wt. % |
| 25.016 | Mo | 40-45 wt. % | Ti | ad 100 wt. % |

TABLE 25-continued

| | Component 1 | Amount of component 1 | Component 2 | Amount of component 2 |
|---|---|---|---|---|
| 25.017 | Ti | 40-45 wt. % | Ta | ad 100 wt. % |
| 25.018 | Ti | 40-45 wt. % | Nb | ad 100 wt. % |
| 25.019 | Ti | 40-45 wt. % | W | ad 100 wt. % |
| 25.020 | Ti | 40-45 wt. % | Mo | ad 100 wt. % |

Table 26: Table 26 consists of 20 alloys, pseudo alloys and powder mixtures according to Table 16, component 1 being present in an amount of 45-50 wt. %, component 2 being present in an amount ad 100 wt. % and the individual partners in the mixture being as listed in Table 16.

TABLE 26

| | Component 1 | Amount of component 1 | Component 2 | Amount of component 2 |
|---|---|---|---|---|
| 26.001 | Nb | 45-50 wt. % | Ta | ad 100 wt. % |
| 26.002 | Nb | 45-50 wt. % | W | ad 100 wt. % |
| 26.003 | Nb | 45-50 wt. % | Mo | ad 100 wt. % |
| 26.004 | Nb | 45-50 wt. % | Ti | ad 100 wt. % |
| 26.005 | Ta | 45-50 wt. % | Nb | ad 100 wt. % |
| 26.006 | Ta | 45-50 wt. % | W | ad 100 wt. % |
| 26.007 | Ta | 45-50 wt. % | Mo | ad 100 wt. % |
| 26.008 | Ta | 45-50 wt. % | Ti | ad 100 wt. % |
| 26.009 | W | 45-50 wt. % | Ta | ad 100 wt. % |
| 26.010 | W | 45-50 wt. % | Nb | ad 100 wt. % |
| 26.011 | W | 45-50 wt. % | Mo | ad 100 wt. % |
| 26.012 | W | 45-50 wt. % | Ti | ad 100 wt. % |
| 26.013 | Mo | 45-50 wt. % | Ta | ad 100 wt. % |
| 26.014 | Mo | 45-50 wt. % | Nb | ad 100 wt. % |
| 26.015 | Mo | 45-50 wt. % | W | ad 100 wt. % |
| 26.016 | Mo | 45-50 wt. % | Ti | ad 100 wt. % |
| 26.017 | Ti | 45-50 wt. % | Ta | ad 100 wt. % |
| 26.018 | Ti | 45-50 wt. % | Nb | ad 100 wt. % |
| 26.019 | Ti | 45-50 wt. % | W | ad 100 wt. % |
| 26.020 | Ti | 45-50 wt. % | Mo | ad 100 wt. % |

Table 27: Table 27 consists of 20 alloys, pseudo alloys and powder mixtures according to Table 16, component 1 being present in an amount of 50-55 wt. %, component 2 being present in an amount ad 100 wt. % and the individual partners in the mixture being as listed in Table 16.

TABLE 27

| | Component 1 | Amount of component 1 | Component 2 | Amount of component 2 |
|---|---|---|---|---|
| 27.001 | Nb | 50-55 wt. % | Ta | ad 100 wt. % |
| 27.002 | Nb | 50-55 wt. % | W | ad 100 wt. % |
| 27.003 | Nb | 50-55 wt. % | Mo | ad 100 wt. % |
| 27.004 | Nb | 50-55 wt. % | Ti | ad 100 wt. % |
| 27.005 | Ta | 50-55 wt. % | Nb | ad 100 wt. % |
| 27.006 | Ta | 50-55 wt. % | W | ad 100 wt. % |
| 27.007 | Ta | 50-55 wt. % | Mo | ad 100 wt. % |
| 27.008 | Ta | 50-55 wt. % | Ti | ad 100 wt. % |
| 27.009 | W | 50-55 wt. % | Ta | ad 100 wt. % |
| 27.010 | W | 50-55 wt. % | Nb | ad 100 wt. % |
| 27.011 | W | 50-55 wt. % | Mo | ad 100 wt. % |
| 27.012 | W | 50-55 wt. % | Ti | ad 100 wt. % |
| 27.013 | Mo | 50-55 wt. % | Ta | ad 100 wt. % |
| 27.014 | Mo | 50-55 wt. % | Nb | ad 100 wt. % |
| 27.015 | Mo | 50-55 wt. % | W | ad 100 wt. % |
| 27.016 | Mo | 50-55 wt. % | Ti | ad 100 wt. % |
| 27.017 | Ti | 50-55 wt. % | Ta | ad 100 wt. % |
| 27.018 | Ti | 50-55 wt. % | Nb | ad 100 wt. % |
| 27.019 | Ti | 50-55 wt. % | W | ad 100 wt. % |
| 27.020 | Ti | 50-55 wt. % | Mo | ad 100 wt. % |

Table 28: Table 28 consists of 20 alloys, pseudo alloys and powder mixtures according to Table 16, component 1 being present in an amount of 55-60 wt. %, component 2 being present in an amount ad 100 wt. % and the individual partners in the mixture being as listed in Table 16.

TABLE 28

| | Component 1 | Amount of component 1 | Component 2 | Amount of component 2 |
|---|---|---|---|---|
| 28.001 | Nb | 55-60 wt. % | Ta | ad 100 wt. % |
| 28.002 | Nb | 55-60 wt. % | W | ad 100 wt. % |
| 28.003 | Nb | 55-60 wt. % | Mo | ad 100 wt. % |
| 28.004 | Nb | 55-60 wt. % | Ti | ad 100 wt. % |
| 28.005 | Ta | 55-60 wt. % | Nb | ad 100 wt. % |
| 28.006 | Ta | 55-60 wt. % | W | ad 100 wt. % |
| 28.007 | Ta | 55-60 wt. % | Mo | ad 100 wt. % |
| 28.008 | Ta | 55-60 wt. % | Ti | ad 100 wt. % |
| 28.009 | W | 55-60 wt. % | Ta | ad 100 wt. % |
| 28.010 | W | 55-60 wt. % | Nb | ad 100 wt. % |
| 28.011 | W | 55-60 wt. % | Mo | ad 100 wt. % |
| 28.012 | W | 55-60 wt. % | Ti | ad 100 wt. % |
| 28.013 | Mo | 55-60 wt. % | Ta | ad 100 wt. % |
| 28.014 | Mo | 55-60 wt. % | Nb | ad 100 wt. % |
| 28.015 | Mo | 55-60 wt. % | W | ad 100 wt. % |
| 28.016 | Mo | 55-60 wt. % | Ti | ad 100 wt. % |
| 28.017 | Ti | 55-60 wt. % | Ta | ad 100 wt. % |
| 28.018 | Ti | 55-60 wt. % | Nb | ad 100 wt. % |
| 28.019 | Ti | 55-60 wt. % | W | ad 100 wt. % |
| 28.020 | Ti | 55-60 wt. % | Mo | ad 100 wt. % |

Also suitable for use in the methods according to the invention are metal powders which consist of alloys, pseudo alloys and powder mixtures of different refractory metals with one another.

For example, alloys of molybdenum and titanium in a ratio of 50:50 atomic percent or alloys of tungsten and titanium in an amount of about 90:10 wt. % are known and are suitable for use in the methods according to the invention. In principle, however, all alloys of the refractory metals with one another are suitable for use in the methods according to the invention.

Binary alloys, pseudo alloys and powder mixtures of refractory metals that are suitable for the methods according to the invention are listed in Tables 16 to 36. Individual materials are designated with the number of the table followed by the number of the combination of components as in Table 16. For example, material 22.005 is a material described in Table 22, the precise composition being defined by the refractory metals, which are listed in Table 16, position no. 5, and the amount as listed in Table 22.

| | Component 1 | Component 2 |
|---|---|---|
| 16.001 | Nb | Ta |
| 16.002 | Nb | W |
| 16.003 | Nb | Mo |
| 16.004 | Nb | Ti |
| 16.005 | Ta | Nb |
| 16.006 | Ta | W |
| 16.007 | Ta | Mo |
| 16.008 | Ta | Ti |
| 16.009 | W | Ta |
| 16.010 | W | Nb |
| 16.011 | W | Mo |
| 16.012 | W | Ti |
| 16.013 | Mo | Ta |
| 16.014 | Mo | Nb |
| 16.015 | Mo | W |
| 16.016 | Mo | Ti |
| 16.017 | Ti | Ta |
| 16.018 | Ti | Nb |
| 16.019 | Ti | W |
| 16.020 | Ti | Mo |

Table 29: Table 29 consists of 20 alloys, pseudo alloys and powder mixtures according to Table 16, component 1 being present in an amount of 60-65 wt. %, component 2 being present in an amount ad 100 wt. % and the individual partners in the mixture being as listed in Table 16.

TABLE 29

| | Component 1 | Amount of component 1 | Component 2 | Amount of component 2 |
|---|---|---|---|---|
| 29.001 | Nb | 60-65 wt. % | Ta | ad 100 wt. % |
| 29.002 | Nb | 60-65 wt. % | W | ad 100 wt. % |
| 29.003 | Nb | 60-65 wt. % | Mo | ad 100 wt. % |
| 29.004 | Nb | 60-65 wt. % | Ti | ad 100 wt. % |
| 29.005 | Ta | 60-65 wt. % | Nb | ad 100 wt. % |
| 29.006 | Ta | 60-65 wt. % | W | ad 100 wt. % |
| 29.007 | Ta | 60-65 wt. % | Mo | ad 100 wt. % |
| 29.008 | Ta | 60-65 wt. % | Ti | ad 100 wt. % |
| 29.009 | W | 60-65 wt. % | Ta | ad 100 wt. % |
| 29.010 | W | 60-65 wt. % | Nb | ad 100 wt. % |
| 29.011 | W | 60-65 wt. % | Mo | ad 100 wt. % |
| 29.012 | W | 60-65 wt. % | Ti | ad 100 wt. % |
| 29.013 | Mo | 60-65 wt. % | Ta | ad 100 wt. % |
| 29.014 | Mo | 60-65 wt. % | Nb | ad 100 wt. % |
| 29.015 | Mo | 60-65 wt. % | W | ad 100 wt. % |
| 29.016 | Mo | 60-65 wt. % | Ti | ad 100 wt. % |
| 29.017 | Ti | 60-65 wt. % | Ta | ad 100 wt. % |
| 29.018 | Ti | 60-65 wt. % | Nb | ad 100 wt. % |
| 29.019 | Ti | 60-65 wt. % | W | ad 100 wt. % |
| 29.020 | Ti | 60-65 wt. % | Mo | ad 100 wt. % |

Table 30: Table 30 consists of 20 alloys, pseudo alloys and powder mixtures according to Table 16, component 1 being present in an amount of 65-70 wt. %, component 2 being present in an amount ad 100 wt. % and the individual partners in the mixture being as listed in Table 16.

TABLE 30

| | Component 1 | Amount of component 1 | Component 2 | Amount of component 2 |
|---|---|---|---|---|
| 30.001 | Nb | 65-70 wt. % | Ta | ad 100 wt. % |
| 30.002 | Nb | 65-70 wt. % | W | ad 100 wt. % |
| 30.003 | Nb | 65-70 wt. % | Mo | ad 100 wt. % |
| 30.004 | Nb | 65-70 wt. % | Ti | ad 100 wt. % |
| 30.005 | Ta | 65-70 wt. % | Nb | ad 100 wt. % |
| 30.006 | Ta | 65-70 wt. % | W | ad 100 wt. % |
| 30.007 | Ta | 65-70 wt. % | Mo | ad 100 wt. % |
| 30.008 | Ta | 65-70 wt. % | Ti | ad 100 wt. % |
| 30.009 | W | 65-70 wt. % | Ta | ad 100 wt. % |
| 30.010 | W | 65-70 wt. % | Nb | ad 100 wt. % |
| 30.011 | W | 65-70 wt. % | Mo | ad 100 wt. % |
| 30.012 | W | 65-70 wt. % | Ti | ad 100 wt. % |
| 30.013 | Mo | 65-70 wt. % | Ta | ad 100 wt. % |
| 30.014 | Mo | 65-70 wt. % | Nb | ad 100 wt. % |
| 30.015 | Mo | 65-70 wt. % | W | ad 100 wt. % |
| 30.016 | Mo | 65-70 wt. % | Ti | ad 100 wt. % |
| 30.017 | Ti | 65-70 wt. % | Ta | ad 100 wt. % |
| 30.018 | Ti | 65-70 wt. % | Nb | ad 100 wt. % |
| 30.019 | Ti | 65-70 wt. % | W | ad 100 wt. % |
| 30.020 | Ti | 65-70 wt. % | Mo | ad 100 wt. % |

Table 31: Table 31 consists of 20 alloys, pseudo alloys and powder mixtures according to Table 16, component 1 being present in an amount of 70-75 wt. %, component 2 being present in an amount ad 100 wt. % and the individual partners in the mixture being as listed in Table 16.

TABLE 31

| | Component 1 | Amount of component 1 | Component 2 | Amount of component 2 |
|---|---|---|---|---|
| 31.001 | Nb | 70-75 wt. % | Ta | ad 100 wt. % |
| 31.002 | Nb | 70-75 wt. % | W | ad 100 wt. % |
| 31.003 | Nb | 70-75 wt. % | Mo | ad 100 wt. % |

TABLE 31-continued

| | Component 1 | Amount of component 1 | Component 2 | Amount of component 2 |
|---|---|---|---|---|
| 31.004 | Nb | 70-75 wt. % | Ti | ad 100 wt. % |
| 31.005 | Ta | 70-75 wt. % | Nb | ad 100 wt. % |
| 31.006 | Ta | 70-75 wt. % | W | ad 100 wt. % |
| 31.007 | Ta | 70-75 wt. % | Mo | ad 100 wt. % |
| 31.008 | Ta | 70-75 wt. % | Ti | ad 100 wt. % |
| 31.009 | W | 70-75 wt. % | Ta | ad 100 wt. % |
| 31.010 | W | 70-75 wt. % | Nb | ad 100 wt. % |
| 31.011 | W | 70-75 wt. % | Mo | ad 100 wt. % |
| 31.012 | W | 70-75 wt. % | Ti | ad 100 wt. % |
| 31.013 | Mo | 70-75 wt. % | Ta | ad 100 wt. % |
| 31.014 | Mo | 70-75 wt. % | Nb | ad 100 wt. % |
| 31.015 | Mo | 70-75 wt. % | W | ad 100 wt. % |
| 31.016 | Mo | 70-75 wt. % | Ti | ad 100 wt. % |
| 31.017 | Ti | 70-75 wt. % | Ta | ad 100 wt. % |
| 31.018 | Ti | 70-75 wt. % | Nb | ad 100 wt. % |
| 31.019 | Ti | 70-75 wt. % | W | ad 100 wt. % |
| 31.020 | Ti | 70-75 wt. % | Mo | ad 100 wt. % |

Table 32: Table 32 consists of 20 alloys, pseudo alloys and powder mixtures according to Table 16, component 1 being present in an amount of 75-80 wt. %, component 2 being present in an amount ad 100 wt. % and the individual partners in the mixture being as listed in Table 16.

TABLE 32

| | Component 1 | Amount of component 1 | Component 2 | Amount of component 2 |
|---|---|---|---|---|
| 32.001 | Nb | 75-80 wt. % | Ta | ad 100 wt. % |
| 32.002 | Nb | 75-80 wt. % | W | ad 100 wt. % |
| 32.003 | Nb | 75-80 wt. % | Mo | ad 100 wt. % |
| 32.004 | Nb | 75-80 wt. % | Ti | ad 100 wt. % |
| 32.005 | Ta | 75-80 wt. % | Nb | ad 100 wt. % |
| 32.006 | Ta | 75-80 wt. % | W | ad 100 wt. % |
| 32.007 | Ta | 75-80 wt. % | Mo | ad 100 wt. % |
| 32.008 | Ta | 75-80 wt. % | Ti | ad 100 wt. % |
| 32.009 | W | 75-80 wt. % | Ta | ad 100 wt. % |
| 32.010 | W | 75-80 wt. % | Nb | ad 100 wt. % |
| 32.011 | W | 75-80 wt. % | Mo | ad 100 wt. % |
| 32.012 | W | 75-80 wt. % | Ti | ad 100 wt. % |
| 32.013 | Mo | 75-80 wt. % | Ta | ad 100 wt. % |
| 32.014 | Mo | 75-80 wt. % | Nb | ad 100 wt. % |
| 32.015 | Mo | 75-80 wt. % | W | ad 100 wt. % |
| 32.016 | Mo | 75-80 wt. % | Ti | ad 100 wt. % |
| 32.017 | Ti | 75-80 wt. % | Ta | ad 100 wt. % |
| 32.018 | Ti | 75-80 wt. % | Nb | ad 100 wt. % |
| 32.019 | Ti | 75-80 wt. % | W | ad 100 wt. % |
| 32.020 | Ti | 75-80 wt. % | Mo | ad 100 wt. % |

Table 33: Table 33 consists of 20 alloys, pseudo alloys and powder mixtures according to Table 16, component 1 being present in an amount of 80-85 wt. %, component 2 being present in an amount ad 100 wt. % and the individual partners in the mixture being as listed in Table 16.

TABLE 33

| | Component 1 | Amount of component 1 | Component 2 | Amount of component 2 |
|---|---|---|---|---|
| 33.001 | Nb | 80-85 wt. % | Ta | ad 100 wt. % |
| 33.002 | Nb | 80-85 wt. % | W | ad 100 wt. % |
| 33.003 | Nb | 80-85 wt. % | Mo | ad 100 wt. % |
| 33.004 | Nb | 80-85 wt. % | Ti | ad 100 wt. % |
| 33.005 | Ta | 80-85 wt. % | Nb | ad 100 wt. % |
| 33.006 | Ta | 80-85 wt. % | W | ad 100 wt. % |
| 33.007 | Ta | 80-85 wt. % | Mo | ad 100 wt. % |
| 33.008 | Ta | 80-85 wt. % | Ti | ad 100 wt. % |
| 33.009 | W | 80-85 wt. % | Ta | ad 100 wt. % |
| 33.010 | W | 80-85 wt. % | Nb | ad 100 wt. % |
| 33.011 | W | 80-85 wt. % | Mo | ad 100 wt. % |

TABLE 33-continued

| | Component 1 | Amount of component 1 | Component 2 | Amount of component 2 |
|---|---|---|---|---|
| 33.012 | W | 80-85 wt. % | Ti | ad 100 wt. % |
| 33.013 | Mo | 80-85 wt. % | Ta | ad 100 wt. % |
| 33.014 | Mo | 80-85 wt. % | Nb | ad 100 wt. % |
| 33.015 | Mo | 80-85 wt. % | W | ad 100 wt. % |
| 33.016 | Mo | 80-85 wt. % | Ti | ad 100 wt. % |
| 33.017 | Ti | 80-85 wt. % | Ta | ad 100 wt. % |
| 33.018 | Ti | 80-85 wt. % | Nb | ad 100 wt. % |
| 33.019 | Ti | 80-85 wt. % | W | ad 100 wt. % |
| 33.020 | Ti | 80-85 wt. % | Mo | ad 100 wt. % |

Table 34: Table 34 consists of 20 alloys, pseudo alloys and powder mixtures according to Table 16, component 1 being present in an amount of 85-90 wt. %, component 2 being present in an amount ad 100 wt. % and the individual partners in the mixture being as listed in Table 16.

TABLE 34

| | Component 1 | Amount of component 1 | Component 2 | Amount of component 2 |
|---|---|---|---|---|
| 34.001 | Nb | 85-90 wt. % | Ta | ad 100 wt. % |
| 34.002 | Nb | 85-90 wt. % | W | ad 100 wt. % |
| 34.003 | Nb | 85-90 wt. % | Mo | ad 100 wt. % |
| 34.004 | Nb | 85-90 wt. % | Ti | ad 100 wt. % |
| 34.005 | Ta | 85-90 wt. % | Nb | ad 100 wt. % |
| 34.006 | Ta | 85-90 wt. % | W | ad 100 wt. % |
| 34.007 | Ta | 85-90 wt. % | Mo | ad 100 wt. % |
| 34.008 | Ta | 85-90 wt. % | Ti | ad 100 wt. % |
| 34.009 | W | 85-90 wt. % | Ta | ad 100 wt. % |
| 34.010 | W | 85-90 wt. % | Nb | ad 100 wt. % |
| 34.011 | W | 85-90 wt. % | Mo | ad 100 wt. % |
| 34.012 | W | 85-90 wt. % | Ti | ad 100 wt. % |
| 34.013 | Mo | 85-90 wt. % | Ta | ad 100 wt. % |
| 34.014 | Mo | 85-90 wt. % | Nb | ad 100 wt. % |
| 34.015 | Mo | 85-90 wt. % | W | ad 100 wt. % |
| 34.016 | Mo | 85-90 wt. % | Ti | ad 100 wt. % |
| 34.017 | Ti | 85-90 wt. % | Ta | ad 100 wt. % |
| 34.018 | Ti | 85-90 wt. % | Nb | ad 100 wt. % |
| 34.019 | Ti | 85-90 wt. % | W | ad 100 wt. % |
| 34.020 | Ti | 85-90 wt. % | Mo | ad 100 wt. % |

Table 35: Table 35 consists of 20 alloys, pseudo alloys and powder mixtures according to Table 16, component 1 being present in an amount of 90-95 wt. %, component 2 being present in an amount ad 100 wt. % and the individual partners in the mixture being as listed in Table 16.

TABLE 35

| | Component 1 | Amount of component 1 | Component 2 | Amount of component 2 |
|---|---|---|---|---|
| 35.001 | Nb | 90-95 wt. % | Ta | ad 100 wt. % |
| 35.002 | Nb | 90-95 wt. % | W | ad 100 wt. % |
| 35.003 | Nb | 90-95 wt. % | Mo | ad 100 wt. % |
| 35.004 | Nb | 90-95 wt. % | Ti | ad 100 wt. % |
| 35.005 | Ta | 90-95 wt. % | Nb | ad 100 wt. % |
| 35.006 | Ta | 90-95 wt. % | W | ad 100 wt. % |
| 35.007 | Ta | 90-95 wt. % | Mo | ad 100 wt. % |
| 35.008 | Ta | 90-95 wt. % | Ti | ad 100 wt. % |
| 35.009 | W | 90-95 wt. % | Ta | ad 100 wt. % |
| 35.010 | W | 90-95 wt. % | Nb | ad 100 wt. % |
| 35.011 | W | 90-95 wt. % | Mo | ad 100 wt. % |
| 35.012 | W | 90-95 wt. % | Ti | ad 100 wt. % |
| 35.013 | Mo | 90-95 wt. % | Ta | ad 100 wt. % |
| 35.014 | Mo | 90-95 wt. % | Nb | ad 100 wt. % |
| 35.015 | Mo | 90-95 wt. % | W | ad 100 wt. % |
| 35.016 | Mo | 90-95 wt. % | Ti | ad 100 wt. % |

TABLE 35-continued

| | Component 1 | Amount of component 1 | Component 2 | Amount of component 2 |
|---|---|---|---|---|
| 35.017 | Ti | 90-95 wt. % | Ta | ad 100 wt. % |
| 35.018 | Ti | 90-95 wt. % | Nb | ad 100 wt. % |
| 35.019 | Ti | 90-95 wt. % | W | ad 100 wt. % |
| 35.020 | Ti | 90-95 wt. % | Mo | ad 100 wt. % |

Table 36: Table 36 consists of 20 alloys, pseudo alloys and powder mixtures according to Table 16, component 1 being present in an amount of 95-99 wt. %, component 2 being present in an amount ad 100 wt. % and the individual partners in the mixture being as listed in Table 16.

TABLE 36

| | Component 1 | Amount of component 1 | Component 2 | Amount of component 2 |
|---|---|---|---|---|
| 36.001 | Nb | 95-99 wt. % | Ta | ad 100 wt. % |
| 36.002 | Nb | 95-99 wt. % | W | ad 100 wt. % |
| 36.003 | Nb | 95-99 wt. % | Mo | ad 100 wt. % |
| 36.004 | Nb | 95-99 wt. % | Ti | ad 100 wt. % |
| 36.005 | Ta | 95-99 wt. % | Nb | ad 100 wt. % |
| 36.006 | Ta | 95-99 wt. % | W | ad 100 wt. % |
| 36.007 | Ta | 95-99 wt. % | Mo | ad 100 wt. % |
| 36.008 | Ta | 95-99 wt. % | Ti | ad 100 wt. % |
| 36.009 | W | 95-99 wt. % | Ta | ad 100 wt. % |
| 36.010 | W | 95-99 wt. % | Nb | ad 100 wt. % |
| 36.011 | W | 95-99 wt. % | Mo | ad 100 wt. % |
| 36.012 | W | 95-99 wt. % | Ti | ad 100 wt. % |
| 36.013 | Mo | 95-99 wt. % | Ta | ad 100 wt. % |
| 36.014 | Mo | 95-99 wt. % | Nb | ad 100 wt. % |
| 36.015 | Mo | 95-99 wt. % | W | ad 100 wt. % |
| 36.016 | Mo | 95-99 wt. % | Ti | ad 100 wt. % |
| 36.017 | Ti | 95-99 wt. % | Ta | ad 100 wt. % |
| 36.018 | Ti | 95-99 wt. % | Nb | ad 100 wt. % |
| 36.019 | Ti | 95-99 wt. % | W | ad 100 wt. % |
| 36.020 | Ti | 95-99 wt. % | Mo | ad 100 wt. % |

EXAMPLES

Preparation of a Tantalum Powder

A tantalum hydride powder was mixed with 0.3 wt. % magnesium and placed in a vacuum oven. The oven was evacuated and filled with argon. The pressure was 860 Torr, a stream of argon was maintained. The oven temperature was raised to 650° C. in steps of 50° C. and, after a constant temperature had been established, was maintained for four hours. The oven temperature was then raised to 1000° C. in steps of 50° C. and, after a constant temperature had been established, was maintained for six hours. At the end of this time, the oven was switched off and cooled to room temperature under argon. Magnesium and the resulting compounds were removed in the conventional manner by acid washing. The resulting tantalum powder had a particle size of −100 mesh (<150 μm), an oxygen content of 77 ppm and a specific BET surface area of 255 $cm^2/g$.

Preparation of a Titanium Powder

The procedure was as for the preparation of the tantalum powder. A titanium powder having an oxygen content of 93 ppm was obtained.

Preparation of a Pre-Alloyed Titanium/Tantalum Powder

A mixture of tantalum hydride powder and titanium hydride powder in a molar ratio of 1:1 was prepared and was mixed with 0.3 wt. % magnesium; the procedure as in the preparation of the tantalum powder was then followed. A titanium/tantalum powder having an oxygen content of 89 ppm was obtained.

Production of Coatings

Tantalum and niobium coatings were produced. The tantalum powder used was AMPERIT® 150.090 and the niobium powder used was AMPERIT® 160.090, both of which are commercially available materials from H. C. Starck GmbH in Goslar. The commercially available nozzle of the MOC 29 type from CGT GmbH in Ampfing was used.

| Material | Tantalum | Tantalum | Niobium | Niobium |
|---|---|---|---|---|
| Nozzle | MOC 29 | MOC 29 | MOC 29 | MOC 29 |
| Determination of the feed rate at 0.52 $Nm^3/h$: | | | | |
| 3.0 rpm (g/30 s/g/min) | 35.5/71.0 | 35.5/71.0 | 14.7/29.4 | 14.7/29.4 |
| 4.0 rpm (g/30 s/g/min) | | | 19.8/39.6 | 19.8/39.6 |
| Movement data: | | | | |
| Spray speed/ speed of the nozzle over the substrate (m/min) (mm/s) | 20/333 | 20/333 | 20/333 | 20/333 |
| Line feed (mm) | 1.5 | 1.5 | 1.5 | 1.5 |
| Spraying interval (mm) | 30 | 30 | 30 | 30 |
| Process gas: | Nitrogen | Helium | Nitrogen | Helium |
| Pressure (bar) | 30 | 28 | 30 | 28 |
| Flow ($Nm^3/h$) | 65 | 190/He 181 | 60 | 190/He 181 |
| Proportion of feed gas (%) | 8 | 3 (N2) | 8 | 3 (N2) |
| Powder feed | | | | |
| Powder feed rate (g/min) | 71 | 71 | 39.6 | 39.6 |
| Number of passes | 3 | 3 | 3 | 3 |
| Substrates | 1FTa 1FS 1FV 1FS 1RV 1RS | 1FTa 1FV 2FS 1RV 1RS | 2FS 2FV 1RS 1RV | 2FS 2FV 1RV 1RS |
| Sheet thickness before (mm) | 2.86 | 2.92 | 2.91 | 2.84 |
| Sheet thickness after (mm) | 3.38 | 3.44 | 3.35 | 3.36 |
| Coating thickness, approx. (μm) *) | 520.00 | 520.00 | 436.00 | 524.00 |
| Porosity/Density | 0.9%/99.1% | 2.2%/97.8% | | |

Substrates: The substrates were placed in succession on the specimen holder and coated under the indicated test conditions. The substrate description is made up as follows:

The number at the beginning indicates the number of identical substrates located next to one another. The following letter indicates whether a flat specimen (F) or a round specimen (R, tube) was used. The following letters indicate the material, Ta meaning tantalum, S meaning a structural steel, and V meaning a stainless steel (chromium-nickel steel).

Very strong and dense coatings were obtained, which exhibit low porosity and excellent adhesion to the substrates in question. The flow rate densities were between 11 and 21 $g/sec*cm^2$.

FIGS. 1 to 10 show light microscope pictures of cross-sections of the resulting tantalum coatings. No inclusions of copper or tungsten are detectable, as occurs with corresponding layers produced by vacuum plasma spraying. The porosity determination was carried out automatically by the image analysis program ImageAccess.

FIG. 1: Unetched cross-section of a tantalum coating, process gas helium

FIG. 2: Unetched cross-section of a tantalum coating, process gas helium, overview picture with low magnification FIG. 3: Cross-section of a tantalum coating, etched with hydrofluoric acid, process gas helium, overview picture with low magnification FIG. 4: Cross-section of a tantalum coating, etched with hydrofluoric acid, process gas helium FIG. 5: Image section used for porosity determination, cross-section of a tantalum coating, process gas helium FIG. 6: Cross-section of a tantalum coating, etched with hydrofluoric acid, interface with the substrate, process gas helium FIG. 7: Unetched cross-section of a tantalum coating, process gas nitrogen, overview picture with low magnification FIG. 8: Unetched cross-section of a tantalum coating, process gas nitrogen FIG. 9: Image section used for porosity determination, cross-section of a tantalum coating, process gas nitrogen FIG. 10: Unetched cross-section of a tantalum coating, process gas nitrogen, high magnification

The invention claimed is:

1. A method of applying coatings to a surface, the method comprising:

cold-spraying a gas flow at supersonic speed onto a surface of an object, thereby forming a coating on the surface, the gas flow comprising a mixture of gas with a powder of a bulk material selected from the group consisting of:

a) alloys, pseudo alloys, and powder mixtures of Nb, Ta, W, or Mo with (i) each other, or with Ti or Zr, or (ii) 2-30 wt. % of Co, Ni, Rh, Pd, Pt, Cu, Ag or Au; or b) binary alloys, binary pseudo alloys, and binary powder mixtures of 2-50 wt. % Nb, Ta, W, or Mo with each other or with Ti or Zr, wherein (i) the powder has a particle size of from 0.5 to 150 μm and an oxygen content of less than 1000 ppm, and (ii) the coating has a density of at least 97% of a density of the bulk material.

2. The method as claimed in claim 1, further comprising adding the powder to the gas in an amount such that a flow rate density of the particles of from 0.01 to 200 $g/s\ cm^2$.

3. The method as claimed in claim 1, further comprising adding the powder to the gas in an amount such that a flow rate density of the particles of from 0.05 $g/s\ cm^2$ to 17 $g/s\ cm^2$.

4. The method as claimed in claim 1, wherein the spraying comprises the steps of:

providing a spraying orifice adjacent the surface;

providing the powder to the spraying orifice under pressure;

providing the gas under pressure to the spraying orifice to establish a static pressure at the spraying orifice, thereby forming the gas flow, wherein the gas comprises an inert gas; and locating the spraying orifice in a region of low ambient pressure which is less than 1 atmosphere and which is substantially less than the static pressure at the spraying orifice to provide substantial acceleration of the gas flow.

5. The method as claimed in claim 1, wherein the cold spraying is performed with a cold spray gun and the surface and the cold spray gun are located within a vacuum chamber at a pressure below 80 kPa.

6. The method as claimed in claim 1, wherein a speed of the powder in the gas flow is supersonic to 2000 m/s.

7. The method as claimed in claim 1, wherein the spraying is performed with a cold spray gun and the surface and the cold spray gun are located within a vacuum chamber at a pressure between 2 and 10 kPa and the speed of the powder in the gas flow is supersonic to 1200 m/s.

8. The method as claimed in claim 1, wherein the coating has a particle size of from 5 to 150 μm.

9. The method as claimed in claim 1, wherein the powder has gaseous impurities of from 200 to 2500 ppm, based on weight.

10. The method as claimed in claim 1, wherein the coating has a particle size of from 10 to 50 μm and the powder has an oxygen content of less than 500 ppm.

11. The method as claimed in claim 1, wherein the powder has an oxygen content of less than 100 ppm.

12. The method as claimed in claim 1, wherein the coating has an oxygen content of less than 1000 ppm.

13. The method as claimed in claim 1, wherein the coating has an oxygen content of less than 100 ppm.

14. The method as claimed in claim 1, wherein the coating has a content of gaseous impurities that differs by no more than 50% from a content of gaseous impurities of the powder.

15. The method as claimed in claim 1, wherein the coating has a content of gaseous impurities that differs by no more than 20% from a content of gaseous impurities of the powder.

16. The method as claimed in claim 1, wherein the coating has an oxygen content that differs by no more than 5% from an oxygen content of the powder.

17. The method as claimed in claim 1, wherein the coating has a content of gaseous impurities that differs by no more than 10% from a content of gaseous impurities of the powder.

18. The method as claimed in claim 1, wherein the coating has a content of gaseous impurities that differs by no more than 1% from a content of gaseous impurities of the powder and wherein the coating has an oxygen content that differs by no more than 1% from an oxygen content of the starting powder.

19. The method as claimed in claim 1, wherein an oxygen content of the coating is no more than 100 ppm.

20. The method as claimed in claim 1, wherein a thickness of the coating is from 10 μm to 10 mm.

21. The method as claimed in claim 1, wherein the powder is an alloy having from 94 to 99 wt. % molybdenum, from 1 to 6 wt. %, niobium, and from 0.05 to 1 wt. % zirconium.

22. The method as claimed in claim 1, wherein the powder is an alloy having from 95 to 97 wt. % molybdenum, from 2 to 4 wt. %, niobium, and from 0.05 to 0.02 wt. % zirconium.

23. The method as claimed in claim 1, wherein the powder is an alloy, pseudo alloy, or powder mixture of a refractory metal selected from the group consisting of niobium, tantalum, tungsten, and molybdenum with a metal selected from the group consisting of titanium, cobalt, nickel, rhodium, palladium, platinum, copper, silver, and gold.

24. The method as claimed in claim 1, wherein the powder consists essentially of a tungsten-rhenium alloy.

25. The method as claimed in claim 1, wherein the powder consists essentially of a mixture of a titanium powder with (i) a tungsten powder or (ii) a molybdenum powder.

26. The method as claimed in claim 1, wherein the powder comprises 2-30 wt. % of cobalt, nickel, rhodium, palladium, platinum, copper, silver, or gold.

27. The method as claimed in claim 1, wherein the powder comprises 2-50 wt. % of titanium.

28. A method of applying coatings to a surface, the method comprising:

cold-spraying a gas flow at supersonic speed onto a surface of an object, thereby forming a coating on the surface, the gas flow comprising a mixture of gas with a powder of a bulk material selected from the group consisting of:

a) alloys, pseudo alloys, and powder mixtures of Nb, Ta, W, or Mo with (i) each other, or with Ti or Zr, or (ii) 2-30 wt. % of Co, Ni, Rh, Pd, Pt, Cu, Ag or Au; or b) binary alloys, binary pseudo alloys, and binary powder mixtures of 2-50 wt. % Nb, Ta, W, or Mo with each other or with Ti or Zr, wherein (i) the powder has a particle size of from 0.5 to 150 μm and an oxygen content of less than 1000 ppm, (ii) the coating has a density of at least 97% of a density of the bulk material, and (iii) cold-sprayed layers are formed/produced with deposition rates of more than 90%.

* * * * *